US007367563B2

(12) United States Patent
Yoseloff et al.

(10) Patent No.: US 7,367,563 B2
(45) **Date of Patent: *May 6, 2008**

(54) INTERACTIVE SIMULATED STUD POKER APPARATUS AND METHOD

(75) Inventors: Mark L. Yoseloff, Henderson, NV (US); R. Brooke Dunn, Henderson, NV (US); Philip S. Smith, Las Vegas, NV (US); Roger M. Snow, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 190 days.

This patent is subject to a terminal disclaimer.

(21) Appl. No.: 10/938,484

(22) Filed: Sep. 10, 2004

(65) Prior Publication Data

US 2005/0040601 A1 Feb. 24, 2005

Related U.S. Application Data

(63) Continuation-in-part of application No. 10/602,015, filed on Jun. 23, 2003, now Pat. No. 7,246,799, which is a continuation-in-part of application No. 10/286,370, filed on Oct. 31, 2002, now abandoned, and a continuation-in-part of application No. 10/254,628, filed on Sep. 24, 2002, now abandoned, which is a continuation-in-part of application No. 09/928,645, filed on Aug. 13, 2001, now Pat. No. 6,454,266, which is a continuation-in-part of application No. 09/317,705, filed on May 24, 1999, now Pat. No. 6,273,424, which is a continuation-in-part of application No. 08/970,966, filed on Nov. 14, 1997, now Pat. No. 6,019,374, which is a continuation of application No. 08/695,640, filed on Aug. 12, 1996, now abandoned, which is a continuation-in-part of application No. 08/388,292, filed on Feb. 14, 1995, now Pat. No. 5,544,892, which is a continuation-in-part of application No. 08/043,413, filed on Apr. 6, 1993, now Pat. No. 5,417,430, which is a continuation-in-part of application No. 08/023,196, filed on Feb. 5, 1993, now Pat. No. 5,288,081, said application No. 10/938,484 is a continuation-in-part of application No. 10/764,827, filed on Jan. 26, 2004, and a continuation-in-part of application No. 10/764,995, filed on Jan. 26, 2004, and a continuation-in-part of application No. 10/764,994, filed on Jan. 26, 2004.

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS

| | | | |
|---|---|---|---|
| 3,595,987 | A | 7/1971 | Vlahos |
| 3,667,757 | A | 6/1972 | Holmberg |
| 3,876,208 | A | 4/1975 | Wächtler et al. |
| 3,939,953 | A | 2/1976 | Miyazawa |
| 4,007,487 | A | 2/1977 | Vlahos |
| 4,026,555 | A | 5/1977 | Kirschner et al. |
| 4,100,569 | A | 7/1978 | Vlahos |
| 4,305,586 | A | 12/1981 | Richards |
| 4,344,085 | A | 8/1982 | Vlahos |
| 4,397,509 | A | 8/1983 | Miller et al. |
| 4,445,114 | A | 4/1984 | Stubben |
| 4,508,353 | A | 4/1985 | Meyer et al. |
| 4,530,499 | A | 7/1985 | Breslow et al. |
| 4,593,904 | A | 6/1986 | Graves |
| 4,614,342 | A | 9/1986 | Takashima |
| 4,643,421 | A | 2/1987 | Meyer et al. |
| 4,651,997 | A | 3/1987 | Wood |
| 4,652,998 | A | 3/1987 | Koza et al. |
| 4,658,247 | A | 4/1987 | Aubin |
| 4,659,087 | A | 4/1987 | Shen et al. |
| 4,667,959 | A | 5/1987 | Pfeiffer et al. |
| 4,687,200 | A | 8/1987 | Shirai |
| 4,724,307 | A | 2/1988 | Dutton et al. |
| 4,738,451 | A | 4/1988 | Logg |
| 4,743,022 | A | 5/1988 | Wood |
| 4,756,531 | A | 7/1988 | DiRe et al. |
| 4,807,884 | A | 2/1989 | Breeding |
| 4,813,675 | A | 3/1989 | Greenwood |

4,836,546 A 6/1989 DiRe et al.
4,836,553 A 6/1989 Suttle et al.
4,837,728 A 6/1989 Barrie et al.
4,842,276 A 6/1989 Darby
4,861,041 A 8/1989 Jones et al.
4,882,473 A 11/1989 Bergeron et al.
4,887,819 A 12/1989 Walker
4,906,005 A 3/1990 Manabe
4,948,134 A 8/1990 Suttle et al.
4,995,615 A 2/1991 Cheng
5,000,453 A 3/1991 Stevens et al.
5,019,973 A 5/1991 Wilcox et al.
5,022,653 A 6/1991 Suttle et al.
5,042,635 A 8/1991 Bell
5,042,818 A 8/1991 Weingardt
5,078,405 A 1/1992 Jones et al.
5,090,708 A 2/1992 Gerlitz et al.
5,098,107 A 3/1992 Boylan et al.
5,100,137 A 3/1992 Fulton
5,112,060 A 5/1992 Jones
5,114,155 A 5/1992 Tillery et al.
5,116,055 A 5/1992 Tracy
5,120,057 A 6/1992 Kitaue
5,125,671 A 6/1992 Ueda et al.
5,149,104 A 9/1992 Edelstein
5,150,899 A 9/1992 Kitaue
5,154,429 A 10/1992 LeVasseur
5,159,549 A 10/1992 Hallman, Jr. et al.
5,167,413 A 12/1992 Fulton
5,221,083 A * 6/1993 Dote ..... 463/32
5,248,142 A 9/1993 Breeding
5,275,400 A 1/1994 Weingardt et al.
5,275,415 A 1/1994 Wisted
5,288,077 A 2/1994 Jones
5,288,078 A 2/1994 Capper et al.
5,288,081 A * 2/1994 Breeding ..... 273/292
5,308,065 A 5/1994 Bridgeman et al.
5,317,505 A 5/1994 Karabed et al.
5,326,104 A 7/1994 Pease et al.
5,356,140 A 10/1994 Dabrowski et al.
5,356,145 A 10/1994 Verschoor
5,364,104 A 11/1994 Jones et al.
5,364,105 A 11/1994 Jones
5,374,061 A 12/1994 Albrecht
5,382,025 A 1/1995 Sklansky et al.
5,393,067 A 2/1995 Paulsen et al.
5,414,256 A 5/1995 Gurner et al.
5,417,430 A * 5/1995 Breeding ..... 273/292
5,437,462 A 8/1995 Breeding
5,453,758 A 9/1995 Sato
5,470,080 A 11/1995 Naka et al.
5,472,194 A 12/1995 Breeding et al.
5,494,295 A 2/1996 Potter et al.
5,521,616 A 5/1996 Capper et al.
5,531,440 A 7/1996 Dabrowski et al.
5,544,892 A * 8/1996 Breeding ..... 273/292
5,586,766 A 12/1996 Forte et al.
5,586,936 A 12/1996 Bennett et al.
5,605,334 A 2/1997 McCrea, Jr.
5,616,078 A 4/1997 Oh
5,630,586 A 5/1997 Lowden
5,664,781 A 9/1997 Feola
5,669,816 A 9/1997 Garczynski et al.
5,669,817 A 9/1997 Tarantino
5,676,372 A 10/1997 Sines et al.
5,681,039 A 10/1997 Miller
5,683,085 A 11/1997 Johnson et al.
5,685,774 A 11/1997 Webb
5,688,174 A 11/1997 Kennedy
5,695,189 A 12/1997 Breeding et al.
5,697,614 A 12/1997 Potter et al.
5,722,893 A 3/1998 Hill et al.
5,726,706 A 3/1998 Walsh
5,735,742 A 4/1998 French
5,743,800 A 4/1998 Huard et al.
5,745,166 A 4/1998 Rhodes et al.
5,769,422 A 6/1998 Stromer
5,775,992 A 7/1998 Wood et al.
5,779,546 A 7/1998 Meissner et al.
5,781,647 A 7/1998 Fishbine et al.
5,803,453 A 9/1998 Stephan et al.
5,810,663 A 9/1998 Bochichio et al.
5,820,460 A 10/1998 Fulton
5,831,527 A 11/1998 Jones, II et al.
5,848,932 A 12/1998 Adams
5,851,011 A 12/1998 Lott
5,863,041 A 1/1999 Boylan et al.
5,879,235 A 3/1999 Kaneko et al.
5,897,235 A 4/1999 Honma
5,901,958 A 5/1999 Andrews
5,919,090 A 7/1999 Mothwurf
5,923,364 A 7/1999 Rhodes et al.
5,934,998 A 8/1999 Forte et al.
5,941,769 A 8/1999 Order
5,944,310 A 8/1999 Johnson et al.
5,947,821 A 9/1999 Stone
5,957,459 A 9/1999 Chae
5,961,121 A 10/1999 Brown
5,976,019 A 11/1999 Ikeda et al.
5,979,897 A 11/1999 Grossman
5,984,309 A 11/1999 Santin
5,984,310 A 11/1999 English
5,988,643 A 11/1999 Awada
6,012,719 A 1/2000 Webb
6,019,368 A 2/2000 Sines et al.
6,019,374 A * 2/2000 Breeding ..... 273/292
6,036,190 A 3/2000 Edmunds et al.
6,039,650 A 3/2000 Hill
6,056,641 A 5/2000 Webb
6,068,258 A 5/2000 Breeding et al.
6,093,103 A 7/2000 McCrea, Jr.
6,117,012 A 9/2000 McCrea, Jr.
6,126,166 A 10/2000 Lorson et al.
6,135,453 A 10/2000 Srichayaporn
6,139,014 A 10/2000 Breeding et al.
6,149,154 A 11/2000 Grauzer et al.
6,154,131 A 11/2000 Jones, II et al.
6,165,069 A 12/2000 Sines et al.
6,217,447 B1 4/2001 Lofink et al.
6,237,916 B1 5/2001 Webb
6,250,632 B1 6/2001 Albrecht
6,254,096 B1 7/2001 Grauzer et al.
6,267,248 B1 7/2001 Johnson et al.
6,270,404 B2 8/2001 Sines et al.
6,273,424 B1 * 8/2001 Breeding ..... 273/292
6,299,534 B1 10/2001 Breeding
6,299,536 B1 10/2001 Hill
6,313,871 B1 11/2001 Schubert
6,325,373 B1 12/2001 Breeding et al.
6,334,614 B1 1/2002 Breeding
6,345,823 B1 2/2002 Webb
6,361,044 B1 3/2002 Block et al.
6,386,973 B1 * 5/2002 Yoseloff ..... 463/13
6,394,898 B1 5/2002 Nagao et al.
6,403,908 B2 6/2002 Stardust et al.
6,406,020 B1 6/2002 Reed
6,454,266 B1 * 9/2002 Breeding et al. ..... 273/292
6,460,848 B1 10/2002 Soltys et al.
6,466,220 B1 10/2002 Cesana et al.
6,469,747 B1 10/2002 Rai et al.
6,517,435 B2 2/2003 Soltys et al.
6,517,436 B2 2/2003 Soltys et al.
6,519,283 B1 2/2003 Cheney et al.
6,520,857 B2 2/2003 Soltys et al.
6,527,271 B2 3/2003 Soltys et al.
6,530,836 B2 3/2003 Soltys et al.

| | | | | |
|---|---|---|---|---|
| 6,530,837 | B2 | 3/2003 | Soltys et al. | |
| 6,530,842 | B1 * | 3/2003 | Wells et al. | 463/46 |
| 6,532,297 | B1 | 3/2003 | Lindquist | |
| 6,533,276 | B2 | 3/2003 | Soltys et al. | |
| 6,533,662 | B2 | 3/2003 | Soltys et al. | |
| 6,568,678 | B2 | 5/2003 | Breeding et al. | |
| 6,579,180 | B2 | 6/2003 | Soltys et al. | |
| 6,579,181 | B2 | 6/2003 | Soltys et al. | |
| 6,588,751 | B1 | 7/2003 | Grauzer et al. | |
| 6,595,857 | B2 | 7/2003 | Soltys et al. | |
| 6,607,443 | B1 * | 8/2003 | Miyamoto et al. | 463/40 |
| 6,629,894 | B1 | 10/2003 | Purton | |
| 6,638,161 | B2 | 10/2003 | Soltys et al. | |
| 6,651,981 | B2 | 11/2003 | Grauzer et al. | |
| 6,651,982 | B2 | 11/2003 | Grauzer et al. | |
| 6,651,985 | B2 | 11/2003 | Sines et al. | |
| 6,652,379 | B2 | 11/2003 | Soltys et al. | |
| 6,655,684 | B2 | 12/2003 | Grauzer et al. | |
| 6,658,750 | B2 | 12/2003 | Scheibner et al. | |
| 6,661,425 | B1 | 12/2003 | Hiroaki | |
| 6,663,490 | B2 | 12/2003 | Soltys et al. | |
| 6,698,759 | B2 | 3/2004 | Webb et al. | |
| 6,866,581 | B2 * | 3/2005 | Martinek et al. | 463/16 |
| 6,959,927 | B1 * | 11/2005 | Jacobs et al. | 273/292 |
| 2002/0169013 | A1 | 11/2002 | Serizawa et al. | |
| 2003/0199316 | A1 | 10/2003 | Miyamoto et al. | |

FOREIGN PATENT DOCUMENTS

| | | |
|---|---|---|
| EP | 0443420 | 8/1991 |
| GB | 9414822 | 7/1994 |
| GB | 9426324 | 12/1994 |
| JP | 2660586 | 6/1997 |
| WO | WO 00/30856 | 6/2000 |
| WO | WO 00/51076 | 8/2000 |

OTHER PUBLICATIONS

The New Complete Holye Revised, Morehead et al., Doubleday Press, 1991, pp. 28-30.
Scame, Jr., "Scame's Encyclopedia of Games", Harper & Row Publishers, First Edition, "Pontoon", p. 288, "Scamery Baccarat"®, pp. 299-304, and "Three-In-One", p. 383.
Scame, Jr., "Scame's Encyclopedia of Games", Harper & Row Publishers, First Edition, pp. 33-41, Stud Poker, 1973.
J. Scame, "Scame's Guide to Modern Poker", Constable and Company Limited, 1979, "Pokino", pp. 160-162.
"Wild Deuces", Michigan Legionaire, vol. XXXII, No. 10, 1 page, (Oct. 1978).
"Declaration of Jim Kilby Under 37 CFR 1.132", 2 pages (May 9, 1995).
Second Amended Petition filed in the Civil Action "In the Matter of the Petition of IGT for Certain Declaratory Rulings and for the Authorization for the Implementation of the Game of Progressive-21". pp. 1-9 (1992).
"Wheel of Gold", Product Information published by Anchor Games, 11 pages (Oct. 1995).
Gros, R., "Working Within the Systems", Casino Journal, vol. 8, No. 12 pp. 10-11, 13 15, 4 (Dec. 1992).
Smith, C., "Bar Bosses See New Trivia Game Filling More Seats", The Vancouver Sun, 1 page (Feb. 21, 1990).
"Over/Under 13 Blackjack", Product Brochure published by Gaming Concepts, Inc., 3 pages, 1988.
John Scame Games Inc., Scame's Guide to Modern Poker, 1980, Draw Poker Variation of Spit in the Ocean, pp. 139-153.
Scame's Encylcopedia of Games, John Scame, Harper & Row Publishers, 1973, 1983, pp. 278-281, "Banking Card Games".
"Poker is the name of the Game", Walter Gibson, 1974, Chapter VIII, Spit in the Ocean (not clearly readable).
"Hoyle's Modem Encyclopedia of Card Games", Walter Gibson, 1993, p. 268-271. (not clearly readable).
"Hoyle's Rules of Games", Edited by Morehead and Mott-Smith, pp. 34-63, "Poker", 1983.
"Hoyle's Rule of Games", Edited by Morehead and Mott-Smith, pp. 64-96, 1983.
"Wheel'em™ Stud Poker," Brochure, by DigiDeal Corporation, Spokane, Washington as shown at G2E Expo, Oct. 2004, Las Vegas, Nevada.
"Trips or Better™ Rollover Stud Poker," Brochure, by DigiDeal Corporation, Spokane, Washinton as shown at G2E Expo, Oct. 2004, Las Vegas, Nevada.

* cited by examiner

*Primary Examiner*—Stephen Blau
*Assistant Examiner*—Dolores R. Collins
(74) *Attorney, Agent, or Firm*—Mark A. Litman & Associates PA

(57) ABSTRACT

A multi-player automated casino table card game platform enables play of casino table poker-type games according to rules effected through a processor. Rules may include games similar to Let It Ride® stud poker such as playing a wagering game comprising a player placing a wager comprising at least two distinct parts and providing to the player at least a portion of the player's game elements so that partial information or a game outcome is provided; giving the player at least one opportunity, before the player's final game outcome is determined, to withdraw from engagement in the game at least one part of said at least two parts, but less than all of said at least two parts, and continuing play of the game with additional portions of the player's game elements being displayed to the player.

13 Claims, 9 Drawing Sheets

INTERACTIVE SIMULATED STUD POKER APPARATUS AND METHOD

RELATED APPLICATION DATA

This Application is a continuation-in-part Application of U.S. patent application Ser. No. 10/602,015, filed on Jun. 23, 2003 now U.S. Pat. No. 7,246,799, which is in turn a continuation-in-part application of both U.S. patent application Ser. No. 10/286,370, filed Oct. 31, 2002 (Now abandoned) and U.S. patent application Ser. No. 10/254,628, filed Sep. 24, 2002 (Now abandoned); which last application is in turn a continuation-in-part of U.S. patent application Ser. No. 09/928,645, filed Aug. 13, 2001, now U.S. Pat. No. 6,454,266; which is a continuation-in-part of U.S. patent application Ser. No. 09/317,705, filed May 24, 1999, now U.S. Pat. No. 6,273,424; which is a continuation-in-part of U.S. patent application Ser. No. 08/970,966, filed Nov. 14, 1997, now U.S. Pat. No. 6,019,374; which is in turn is a continuation of U.S. patent application Ser. No. 08/695,640, filed Aug. 12, 1996, now abandoned; which is a continuation-in-part of U.S. patent application Ser. No. 08/388,292, filed Feb. 14, 1995, now U.S. Pat. No. 5,544,892; which is in turn a continuation-in-part of U.S. patent application Ser. No. 08/043,413, filed Apr. 6, 1993, now U.S. Pat. No. 5,417,430; which is a continuation-in-part of U.S. patent application Ser. No. 08/023,196, filed on Feb. 5, 1993, now U.S. Pat. No. 5,288,081. This Application is also a continuation-in-part of U.S. patent application Ser. No. 10/764,827; 10/624,994; and 10/624,995, all filed on Jan. 26, 2004.

BACKGROUND OF THE INVENTION

1. Field of the Invention

The present invention relates to an automated gaming platform, particularly an automated gaming platform that can support multiple players, automated gaming apparatus with a virtual dealt on a multi-player platform, and the implementation of stud poker games and methods on the platform.

2. Background of the Art

In the gaming industry, significant gambling occurs at live table games that use playing cards and a live dealer. Exemplary live table games include blackjack, poker, poker variants such as Let It Ride® stud poker, baccarat, casino war and other games. There are a number of proprietary or specialty live table card games which have developed, such as pai-gow poker, Let-It-Ride® stud poker, Three Card Poker® game, Four Card Poker® game, Caribbean Stud® poker and others. These and many other games all involve play using playing cards. The cards are dealt by a live dealer to the players, to a flop and/or to the dealer. The use of playing cards provided by a live dealer has a number of associated limitations and disadvantages that have long plagued the casino industry. Some of these are of general concern to all or most playing card games. Others are problems associated with the use of playing cards in particular games. Some of the principal concerns and problems are discussed below.

The use of playing cards at live table games typically involves several operational requirements that are time-consuming. These operations are conveniently described as collecting, shuffling, dealing and reading of the cards. In many card games there is also a step of cutting the deck after it has been shuffled. In the collecting operation, a live dealer typically collects the cards just played at the end of a hand of play. This is done in preparation for playing the next hand of cards. The cards must often be collected in the specific order in which they had appeared in the play of the game and must also be collected in a specific orientation, such as all cards being in a facedown or face-up condition. The cards also are typically straightened into a stack with the long sides and short sides aligned. These manipulations take time and are not typically appreciated by either the dealer or players as enhancing the play and entertainment value of the game. The use of physical cards also adds a regular cost to play of the game in the wear on decks of cards that must be replaced every few hours. In many games the cards collected at the end of the hand are deposited in a discard rack that collects the played cards until the time a new stack is obtained or the stack is shuffled. In some games the cards are immediately shuffled into the stack either manually or using a card shuffling machine. More typically, the cards are collected and then shuffling is performed later by the dealer or a shuffling device controlled by the dealer.

When shuffling is needed, it involves a break in the action of the table game and consumes a significant amount of time. Shuffling is also the most time consuming operation in preparing for the next hand. Thus, shuffling is of substantial financial significance to the casino industry because it requires significant time and reduces the number of hands that can be played per hour or other period of time. The earnings of casinos are primarily dependent upon the total number of hands played. This is true because the casino on average wins a certain percent of the amounts wagered, and many or most casinos are open on a 24-hour basis. Thus, earnings are limited by the number of hands that can be played per hour. In light of this there has been a significant and keen interest by casino owners to develop practices that allow more games to be played in a given amount of time. Accomplishing this without detracting from the players' enjoyment and desire to play the game is a challenging and longstanding issue with casino owners and consultants in the gaming industry. The use of high quality shuffling machines, such as those produced by Shuffle Master, Inc. (Las Vegas, Nev.) as shown in U.S. Pat. Nos. 6,655,684; 6,651,982; 6,588,751; 6,658,750; 6,568,678; 6,325,373; 6,254,096; 6,149,154; 6,139,014; 6,068,258; and 5,695,189 have significantly reduced the problem in down time, but there is still the need for a human operator and a human dealer in the use of these shuffling devices for casino table games.

The amount of time consumed by collecting, shuffling and dealing is also of significance in private card games because it also delays action and requires some special effort to perform. In private games there is also some added complexity due to card players remembering or figuring out which player had previously dealt and who should now shuffle and/or-deal the cards as needed.

In addition to the time delay and added activity needed to collect, shuffle and deal cards, there is typically some time devoted to cutting the deck of cards which have been shuffled and which are soon to be dealt. This traditional maneuver helps to reduce the risk that the dealer who has shuffled the cards may have done so in a way that stacks the deck in an ordered fashion that may favor the dealer or someone else playing the game. Although cutting the deck does not require a large amount of time, it does take some time. The amount of time spent on cutting also somewhat reduces the frequency at which hands of the card game can be played and introduces another physical step in which human error or design can be introduced, such as dropping and exposing the cards or cutting the deck in a specific position to control the outcome in a fixed deck.

In the gaming industry there is also a very significant amount of time and effort devoted to security issues that relate to play of the casino games. Part of the security concerns stem from frequent attempts to cheat during play of the games. Attempts to cheat are made by players, dealers, or more significantly by dealers and players in collusion. This cheating seeks to affect the outcome of the game in a way that favors the dealer or players who are working together. The amount of cheating in card games is significant to the casino industry and constitutes a major security problem that has large associated losses. The costs of efforts to deter or prevent cheating are very large and made on a daily basis. Many of the attempts to cheat in the play of live table card games involve some aspect of dealer or player manipulation of cards during collection, shuffling, cutting or dealing of cards. Thus, there is a need for methods and apparatus that can be used in the play of live table card games that reduce the ability of the dealer and/or players to cheat by manipulation of playing cards. Of greatest concern are schemes whereby the deck is stacked and the stacked deck is used to the collusive player's advantage. Stacked decks represent huge potential losses since the player is aware of the cards which will be played before play occurs and can optimize winnings by increasing bets for winning hands and decreasing bets for losing hands. It is also desirable to provide decks or groups of cards where card counters are disadvantaged because of the reduction in their ability to track distributions of cards in the group of cards used for play. Continuous shufflers, in which cards are reintroduced into the group of cards being used, the introduction being random throughout the entire group, helps to eliminate that aspect of improper behavior at the gaming table.

Casinos have recognized that their efforts to reduce cheating would be improved if the casino had comprehensive information on the cards which have been played, the amounts bet, the players and dealers involved and other information about actions which have taken place at the card tables. This is of particular importance in assessing the use of stacked decks. It is also important where card tracking is occurring. Additional explanation about card tracking is discussed below. The information desired by the casinos includes knowing the sequence and exact cards being dealt. It would be even more advantageous to the casino if physical cards and live dealers could be eliminated, as this would remove almost all major existing methods of fraud from casino table card games.

Some attempts have been made to record card game action. The best current technology involves cameras that are mounted above the tables to record the action of the card games. This approach is disadvantaged by the fact that not all cards dealt are easily imaged from a camera position above the table because some or all of the cards are not dealt face-up, or are hidden by overlying cards. Although many blackjack games are sufficiently revealing to later determine the order of dealt cards, others are not. Other card games, such as poker, have hands that are not revealed. The covered cards of the players do not allow the order of dealt cards to be ascertained from an above-table camera or on table cameras, as exemplified by U.S. Pat. Nos. 6,313,871 (Schubert); 5,781,647 (Fishbine); and numerous patents assigned to MindPlay LLC (e.g., U.S. Pat. Nos. 6,663,490; 6,652,379; 6,638,161; 6,595,857; 6,579,181; 6,579,180; 6,533,662; 6,533,276; 6,530,837; 6,530,836; 6,527,271; 6,520,857; 6,517,436; 6,517,435; and 6,460,848.

Even where cameras are used, their use may not be effective. Such cameras may require time-consuming and tedious human analysis to go over the videotapes or other recordings of table action or require the use of software that is complex and imprecise. In some present systems, some human study may be needed just to ascertain the sequence of cards dealt or to determine the amount of betting or to confirm software determinations from camera read data. Such human analysis is costly and cannot economically be used to routinely monitor all action in a casino card room or table game pit.

For the above reasons, the video camera monitoring techniques have found very limited effectiveness as a routine approach for identifying cheating. There has also been relatively limited use as a serious analytical tool because of the difficulty of analysis. Such camera surveillance techniques are also of only limited effectiveness as a deterrent because many of the people involved with cheating have a working knowledge of their limitations and utilize approaches which are not easily detectible by such systems.

Another use of video camera monitoring and recording has been made in the context of analyzing card table action after someone has become a cheating or card counting suspect. The tape recordings serve as evidence to prove the cheating scheme. However, in the past, this has generally required other evidence to initially reveal the cheating so that careful analysis can be performed. More routine and general screening to detect cheating has remained a difficult and continuing problem for casinos. This is also a human intensive review, with both video monitoring security personnel and live personnel watching the players and apprehending players at the tables.

Another approach to reducing security problems utilizes card shoes having card detection capability. Card shoes hold a stack of cards containing typically from one to eight decks of cards. The cards are held in the card shoe in preparation for dealing and to secure the deck within a device that restricts access to the cards and helps prevent card manipulations. Card shoes can be fit with optical or magnetic sensors that detect the cards as they are being dealt. Some of the problems of security analysis using above-table cameras is reduced when the sequence of cards dealt can be directly determined at the card shoe using optical or magnetic sensors.

One advantage of such card shoes is that the card sequence information can be collected in a machine-readable format by sensing the specific nature (suit and rank) of each card as they are dealt out of the card shoe. However, most such card shoes have special requirements for the cards being used. Such cards must carry magnetic coding or are specifically adapted for optical reading. This increases the cost of the cards and may not fully resolve the problems and difficulties in obtaining accurate information concerning sequence information. The automated data collecting card shoes also do not have an inherent means for collecting data on the assignment of the card to a particular player or the dealer. They further do not collect data on the amounts bet. These factors thus require some other manual or partially automated data collection system to be used, or require that time-consuming human analysis be performed using video tapes as explained above.

The use in blackjack of numerous card decks, such as six decks, has been one strategy directed at minimizing the risk of card tracking or counting, especially when the set of cards is cut relatively shallowly so that many cards are not allowed into play from the set. Such tracking should be contrasted with card counting strategies which are typically less accurate and do not pose as substantial a risk of loss to the casino. Use of numerous card decks in a stack along with proper cut card placement can also reduce the risk of effective card counting. However, it has been found that multiple decks are not sufficient to overcome the skilled gambler's ability to track cards and turn the advantage against the house.

Card tracking can be thought of as being of two types. Sequential card tracking involves determination of the specific ordering of the card deck or decks being dealt. This can be determined or closely estimated for runs of cards, sequences of cards forming a portion or portions of a stack. Sequential card tracking can be devastating to a casino since a player taking advantage of such information can bet large in a winning situation and change the odds in favor of the player and against the casino.

Slug tracking involves determining runs of the deck or stack that show a higher frequency of certain important cards. For example, in the play of blackjack there are a relatively large number of 10-count cards. These 10-count cards are significant in producing winning blackjack hands or 20-count hands that are also frequently winning hands. Gamblers who are proficient in tracking slugs containing large numbers of 10-count cards can gain an advantage over the house and win in blackjack.

There is also a long-standing problem in the play of blackjack which concerns the situation when the dealer receives a blackjack hand in the initial two cards dealt. If the dealer has a 10-count card or ace as the up card, then it is possible for the dealer to have a blackjack. If the dealer does have a blackjack, then there is no reason to play the hand out since the outcome of the hand is already determined without further dealing. If the hand is fully played out, and the dealer then reveals that the dealer has received a blackjack hand, then a significant amount of time has been wasted. It also causes players to often be upset when a hand is played out to no avail. In many casinos the waste of time associated with playing out hands with a winning dealer blackjack has lead to various approaches that attempt to end the hand after the initial deal. Some of these allow the dealer to look at the down card to make a determination whether a blackjack hand has been dealt to the dealer. This looking is commonly called "peeking" and is an operation that has been the source of numerous cheating schemes involving dealers and players who work in collusion. In such cheating associated with peeking at the down card, the dealer cheats in collaboration with an accomplice-player. This cheating is frequently accomplished when the dealer signals the accomplice using eye movements, hand movements or other signals. If a dealer does not peek, then he does not know the value of his hand until after the players have completed their play. If the dealer does peek, then he can use such eye movements, hand movements or other techniques to convey instructions to his accomplice-player. These signals tell the accomplice what hand the dealer has been dealt. With this knowledge of the dealer's hand, the accomplice has improved odds of winning and this can be sufficient to turn the long-term odds in favor of the accomplice-player and against the casino. Many casinos do not allow the dealer to look at or inspect the down card until all insurance wagers have been made or declined.

There have also been a substantial number of apparatuses devised to facilitate the peeking procedure or render it less subject to abuse. Such peeking devices are intended to allow determination of whether the dealer has received a blackjack hand; however, this is done without revealing to the dealer what the down card is unless it makes a blackjack. Some of these devices require a special table with a peeking device installed in the table. Others allow the down card to be reviewed using a tabletop device in which the card is inserted. These systems and others involve the use of special playing cards. These devices and methods generally add greater costs and slow the play of the game. The slowed play often occurs to such a degree that it offsets the original purpose of saving the time associated with playing out possible dealer blackjack hands. The prior attempts have often ended up unacceptable and are removed.

Another notable problem suffered by live table games is the intimidation which many novice or less experienced players feel when playing such games. Surveys have indicated that many new or less experienced people who come to a casino are inclined to play slot machines and video card games. These people feel intimidation at a live table game because such games require quick thinking and decision making while other people are watching and waiting. This intimidation factor reduces participation in table games.

A further issue that has developed in the casino business is the public's increasing interest in participating in games that have a very large potential payoff. This may be in part a result of the large amount of publicity surrounding the state operated lotteries. News of huge payoffs is read with keen interest and creates expectations that gaming establishments should provide games with large jackpots. One approach has been the networked or progressive slot machines that use a centralized pool of funds contributed by numerous players. These slot machine systems are relatively more costly to purchase and operate. For many gamblers, this approach is not particularly attractive. This lack of attractiveness may be due to the impersonal and solitary nature of playing slot machines. It may alternatively be for other reasons. Whatever the reason, the public is clearly interested in participating in games that can offer potential jackpots that are very large. Table card games have not been able to satisfactorily address this interest. The continued diminishment in the percent of people who play live table games indicates the need for more attractive games and game systems that address to public's interests.

Further problems associated with live table card games are the costs associated with purchasing, handling and disposal of paper and plastic playing cards. Casinos pay relatively favorable prices for card decks, but the decks roughly cost about $1 per deck at this time. Each casino uses decks for a very limited period of time, typically only one shift, and almost always less than one day. After this relatively brief life in the limelight, the decks are disposed of in a suitable manner. In some cases they can be sold as souvenirs. This is done after the cards are specially marked or portions are punched out to show they have been decommissioned from a casino. This special marking allows the cards to be sold as souvenirs while reducing the risk that they will later be used at the card tables in a cheating scheme which involves slipping a winning card into play at an appropriate point. In other cases the playing cards are simply destroyed or recycled to eliminate this last risk. In any case, the cost of playing cards for a casino is significant and can easily run in the hundreds of thousands of dollars per year.

In addition to the above problems, there are also significant costs associated with handling and storing the new and worn playing cards. Sizable rooms located in the casino complexes are needed just to store the cards as they are coming and going. Thus, the high costs of casino facilities further exacerbate the costs associated with paper and plastic playing cards.

The most significant cost in operation of gaming apparatus is personnel costs. A number of attempts have been made to reduce time requirements for not only the dealers, relief dealers, but also for the supervisors, managers, security and the other staff that are directly or indirectly involved in the operation or maintenance of the games.

A number of attempts have been made to design and provide fully automated gaming machines that duplicate play of casino table card games. These attempts have ranged from and included the highly successful video poker slot games to the mildly successful slot-type blackjack game (for single players). In those systems, the individual player sits at an individual machine, inserts credits/currency/coins, and plays a one-on-one game that is controlled by a processor in the machine or to which the machine is distally connected (networked). These machines are common in casinos, but do not duplicate the ambience of the casino table game with multiple players present.

Another type of attempt for simulating casino table card games is the use of a bank of individual player positions associated with a single dealer position in an attempt to simulate the physical ambiance of a live casino table card game. Such systems are shown in U.S. Pat. No. 4,397,509 (Miller); U.S. Pat. No. 4,614,342 (Takashima); U.S. Pat. No. 4,995,615 (Cheng); U.S. Pat. No. 5,470,080 (Naku); and Published U.S. Patent Applications 2002/0169013 (Serizawa); 2003/0199316 (Miyamoto); and the like. These systems have a video display of a dealer and have individual monitors for display of the players' hands and the dealer hands. The architecture of these systems has generally been designed on a unique basis for each game, and there tends to be a main computer/processor that drives all elements of the game, or two computers/processors that distribute the video control of the dealer image and the remainder of the game elements between the two distinct computer/processors. This tends to maximize the cost of the system and tends to provide a slow system with high processing power demands to keep the operation working at speeds needed to maximize use and profit from the machines.

Sines, U.S. Pat. Nos. 6,651,985 and 6,270,404 describes an automated system for playing live casino table games having tabletop changeable playing card displays and play monitoring security features. Sines U.S. Pat. No. 6,165,069 describes an automated system for playing live casino table games having tabletop changeable playing card displays and monitoring security features.

The latter two patents (U.S. Pat. Nos. 6,270,404 and 6,165,069) are related as continuations and therefore have identical disclosures. U.S. Pat. No. 6,651,985 claims continuation-in-part status from the earliest application (U.S. Pat. No. 6,165,069).

Sines, U.S. Pat. No. 6,651,985, describes the use of a live dealer, even though virtual cards are used. There is no virtual dealer display and no software or architecture controls needed for a virtual dealer display. There are distinct display components for the players' hands and dealer's hand. Looking at FIGS. 23, 24 and 25 (which are identical to the same figures in U.S. Pat. No. 6,651,895, discussed above), it appears that at least for betting functions, the system operates with parallel communication to the player input stations. (See wire connections shown in FIGS. 24 and 25 to the Player Bet Interfaces 196, 198, 201 and 203.)

U.S. Pat. No. 6,607,443 (Miyamoto et al., Kabushiki Kaisha SEGA Enterprises) and Published U.S. Application 2003/0199316 A1 (also KKSE) and particularly FIGS. 1, 2, 3, 7, 9, 10, 11, 12 and 13, discloses a virtual blackjack table system. The main objective of this patent is to have optical data that enables the SEGA system to read hand signals of players, such as calls for hits and Stand signals. The hardware architecture in FIG. 15, as described in the specification at column 11, lines 29-54 show that there are distinct CPU's for the (audio and video, 280, 281, 282, 283) which is driven by the Sub-CPU, which is turn connected to the main CPU (201), with an additional sub-CPU 204 directing the motion sensor system 13, 14, 15, 16, and 32. There are distinct processing blocks for the sound (22), the video (21), the main CPU (20), and the subsystems (13), as well as the components already noted for the motion sensors/facial recognition sensors system.

U.S. Pat. No. 5,221,083 (Dote, SEGA Enterprises, Ltd.) describes a blackjack automated game system that has a reflected video image of a dealer and also has individual satellite player positions, with individual CRT monitors for each player. There is no disclosure of the type of information processing hardware in the system.

U.S. Pat. No. 5,934,998 (Forte and Sines, unassigned) and U.S. Pat. No. 5,586,766 (Forte and Sines, assigned to Casinovations, Inc.) describe a system using physical cards and a physical dealer, with no dealer display, on a blackjack table that has a CPU. FIGS. 6-10 show circuit construction and hardware considerations in the design of the system, including communication architecture. This system provides a count display (e.g., LED display) at each player position to show the player count and dealer count (as appropriate) that is determined from reading of the physical cards. Physical playing chips are also used; with no credit wagering capability is shown.

U.S. Pat. No. 5,159,549 describes a system that provides a multiple player game data processing unit with wager accounting. There are distinct player stations with player input on wagering. There may be a limited amount of intelligence at player stations (see column 4, line 1 through column 7, line 55), but there are multiple lines to each player station.

U.S. Pat. No. 4,614,342 (Takashima) describes an electronic game machine with distinct display units (CRT screens) at the player positions and the dealer position. The dealer screen (10) does not show an image of a dealer, but shows the dealer's card(s) and game information. There are typical player input controls (16) at each player position. The system provided is more like a bank of slot systems than a card table. In addition to a dealer data processor (6), each player position includes a player data processor CPU (30) with player memory (32). The central dealer computer apparently polls the individual player data processors to obtain the status of the events at each position (column 4, lines 1-60; and column 3, lines 8-17).

U.S. Pat. No. 5,586,936 (Bennett et al., assigned to Mikohn Gaming) describes a ticketless control system for monitoring player activity at a table game, such as blackjack. Physical cards and physical chips are shown. Player identity cards identify each player entering play at a table, and a separate ticket printer issues a results ticket (500) at the end of play or reads the ticket at the beginning of play. There is no distinct intelligence apparent at each player position, and there is a central CPU that controls the system (e.g., FIG. 8). Physical chips and a real dealer are apparently used. A phone line (630) is connected from each player position to the CPU (820) through a communications port (814).

U.S. Pat. No. 4,995,615 (Cheng) describes a method and apparatus for performing fair card play. There are individual player positions with individual screens (12) provided for each player. There are three vertical, card-display screens (11, 13, 11) shown for "receiving instructions from the computer to display sequentially the cards being distributed throughout the processing of the play . . . " (Column 4, lines 4-13). There is no visual display of a dealer, there are individual player image panels, and no details of the architecture are shown or described.

U.S. Pat. Nos. 5,879,235; 5,976,019; and 6,394,898, assigned to SEGA Enterprises, Ltd. relate to non-card game systems, such as horse race simulators or ball game simulators (e.g., roulette). There is no dealer or croupier simulation. The horse race simulator is an automated miniature track with physically moving game elements. The point of interest is in evaluating the architecture to see how the intelligence is distributed between the player stations and the wagering screen. The system again shows individual monitors at each player position (80, 81) and no dealer display. The schematics of the electrical architecture in FIG. 11 shows a main board that also includes a Picture Control Section (95), Sound Control Section (96), and a communication control section (107). There is a distinct picture output board (108).

U.S. Pat. No. 6,607,443 (Miyamoto et al., Kabushiki Kaisha Sega Enterprises) shows an automated gaming table device in which there is an upright screen that displays a dealer's image. The particular purpose described in this patent is for recognition of sound and hand movement by players, but there is some description of the dealer screen display. For example, Column 7, line 45 through column 9, line 8 describes the images of the dealer provided on the main central screen 7 during game play. There is disclosure to the effect that a dealer's image and particular expressions and body position are provided (along with sound) of the dealer. There are no details at all with respect to the background, the combination of images or the like.

U.S. Pat. No. 5,221,083 (Dote, Sega Enterprises, Ltd.) shows an automated gaming machine with a vertical image of a dealer presented to players sitting at a kiosk-type counsel. The screen or upright portion 2 has an image of a dealer 4 on a background or georama 13 that is formed on the inner surface of the upright portion 2. There are physical elements (e.g., pillars 14) that may be located in recesses in the upright portion 2 in front of the image to emphasize three-dimensionality. The table 5 is disposed in front of the pillars 14 and the image of the dealer 4 behind the pillars 14. The georama 13 is a physical image or construction, and the image of the dealer is originated in a CRT (e.g., 17) lying with the screen horizontal, and the image from the CRT 17 is reflected from a 45 degree mirror 20 for display to the players. This gives the illusion of the dealer being between the table and the georama background. The georama is a physical element, and has no video background at all. The dealer image is a reflected image, not a direct image. The reference appears to describe a distinct dealer image set against a backdrop of a scene.

It must be remembered that the technology of combining video images is standard commercial technology and is relatively old technology from the 1970's. Although many different backing colors may usefully be employed under special conditions, the most commonly selected backing color is substantially pure blue. Therefore, for clarity of description a blue backing will generally be assumed in the present discussion, and the process will ordinarily be referred to by the customary term, "blue screen process." However, any such simplifying assumptions and terminology, are not intended to imply that other colors may not be used, with corresponding modification of the procedure. For example, U.S. Pat. No. 3,595,987, entitled "Electronic Composite Photography" describes apparatus and operations that can be used in creating such combined video images.

U.S. Pat. No. 4,007,487 (Vlahos, Motion Picture Academy of America) describes an improved electronic compositing procedure and apparatus. The process is typically used in the blue screen process and it is suitable for processing motion pictures of professional quality and the like. The invention provides compensation for color impurity in the backing illumination over a continuous range of effective transparencies of the foreground scene. Applicant's previous method for limiting the blue video component for the foreground scene to permit reproduction of light blue foreground objects is improved by a dual limitation criterion which simultaneously suppresses blue flare light from the backing reflected by foreground objects of selected colors, typically including grey scale and flesh tones. The control signal for attenuating the background scene is developed as a difference function predominantly only at areas occupied by opaque or partially transparent foreground objects, and is developed predominantly as a ratio function at unobstructed backing areas, thereby compensating undesired variations in brightness of the backing illumination, while permitting desired shadows on the backing to be reproduced in the composite picture. This is an overlay imaging process for video imaging.

U.S. Pat. No. 4,100,569 (Vlahos) discloses an electronic circuit for combining foreground and background pictures substantially linearly, and included special arrangements for accommodating objects including both blue and magenta colors in the foreground. The system as described merges of foreground and background pictures through a wide range of transparency of the foreground objects. In addition to the normal type of transparent foreground images, including smoke, glasses, and the like, the edges of moving objects are shown as being partially transparent to provide the illusion of rapid movement.

U.S. Pat. No. 4,344,085 (Vlahos, Vlahos-Gottschalk Research) describes a blue screen imaging compositing process using a clean-up circuit that eliminates problems caused by footprints, dust, and dirt on the "blue-screen" floor or other single color backing for the foreground scene, by modifying the basic linear background control signal by using a dual control signal. The normal linear control signal operates over the entire picture in the normal manner. The second control signal is generated by amplifying the linear control signal and inserting it back into the control circuits via a linear OR gate. Thus, any selected level of the background control signal $E_c$ below 100 percent may be raised to 100 percent without influencing the lower levels of $E_c$. At a background control voltage level of perhaps 80 percent or 90 percent of the full background picture intensity, it may be abruptly increased to 100 percent. Above this selected level, any semi-transparency object, (for example the undesired footprint) is made fully transparent and is not reproduced. Further, while the foregoing signals are reduced to zero at this point, the background scene turn-on signal is raised to full intensity levels. This has the interesting collateral effect that thin wires that may be employed to support foreground objects may be rendered invisible, along with the undesired footprints and dust. There is no disclosure of its use for Video Gaming.

U.S. Pat. No. 6,661,425 describes a method for overlapping images in a display. An information input/output device has an intuitive operating feeling and improved information viewing and discriminating properties. The device comprises an superposing image extraction unit extracting a portion for super positional display from an image to output the extracted image portion as an superposing image, a mask pattern generating unit generating a mask pattern, effectors processing the superposing image, and the mask pattern based on the effect designation information, and a base image generating unit synthesizing the mask pattern image and the original image to generate a base image. The device also comprises a switcher, brightness/contrast controllers adjusting the brightness or contrast of the display image switching means, a control unit, super positional image display unit for superposed demonstration of display image planes of the displays and a display position adjustment mechanism. The display information of the image for display in superposition is demonstrated at a position that appears to be floated or recessed from the basic display plane.

U.S. Pat. No. 6,469,747 describes a video signal mixer with a parabolic signal mixing function, especially useful in scene-by-scene color correction systems and "blue screen" video masking applications. The mixer effects mixing two independent signal sources while smoothly controlling the rate of change during mixing. An input stage receives a first video signal and a second video signal. The mixing circuit mixes the first video signal with the second video signal based on a predetermined parabolic function. An aperture signal circuit in the mixer allows a degree of operator control over the parabolic function. An output stage provides a parabolized output signal. The output signal, which comprises the mixture of the first video signal and the second video signal, eliminates discontinuities in regions of the signal which would otherwise produce discontinuities in prior art types of video signal mixers. There is no specific description of the combining of live images on the screen with a preprogrammed image.

There are many wagering games used for gambling. Such games should be exciting to arouse players' interest and uncomplicated so they can be understood easily by a large number of players. Ideally, the games should include more than one wagering opportunity during the course of the game, yet be able to be played rapidly to a wager resolving outcome. Exciting play, the opportunity to make more than one wager and rapid wager resolution enhance players' interest and enjoyment because the frequency of betting opportunities and bet resolutions is increased.

Wagering games, particularly those intended primarily for play in casinos, should provide players with a sense of participation and control, the opportunity to make decisions, and reasonable odds of winning, even though the odds favor the casino, house, dealer or banker. The game must also meet the requirements of regulatory agencies.

Wagering games, including wagering games for casino play, with multiple wagering opportunities are known. U.S. Pat. Nos. 4,861,041 and 5,087,405 (both to Jones et al.) disclose methods and apparatus for progressive jackpot gaming, respectively. The former patent discloses that a player may make an additional wager at the beginning of a hand, the outcome of the additional wager being determined by of a predetermined arrangement of cards in the player's hand. U.S. Pat. No. 4,836,553 (to Suttle and Jones) discloses a modified version of a five card stud poker game.

Additional symbols may be added to the usual means of playing a game to increase wagering opportunities. This is disclosed in U.S. Pat. No. 5,098,107 (to Boylan et al.). Somewhat similarly, U.S. Pat. No. 3,667,757 (to Holmberg) discloses a board game and apparatus, including a way to allow the player to make a choice with respect to several different alternative types of game play and risk bearing strategies. The alternative play is based on providing cards with additional symbols and therefore, a new set of odds. The game and apparatus disclosed by Holmberg requires new sets of rules, relatively complicated procedures and time for a player to learn the game.

U.S. Pat. No. 5,154,429 (to LeVasseur) involves the dealer playing multiple hands against a player's single hand, whereby the number of hands played in the same amount of time is increased.

U.S. Pat. No. 5,288,081 (Breeding) describes the game Let It Ride(® stud poker which is played in many casinos around the world. That wagering game is played with a single, typical (standard) fifty-two card poker deck and broadly involves the generally well recognized and accepted set of rules, procedures and wager-resolving outcomes of five card poker. The game method comprises each player placing an initial, three-part wager (all bet parts are equal) to participate in the game. A separate bonus wager (a side bet wager) may be placed to play against a pay table. Cards are dealt by a dealer, three down to each player and two down to the dealer. Players inspect or "sweat" their cards, and the dealer asks, "take it or leave it?" or as the name of the game implies, "Let It Ride®?" with regard to the first part of the initial bet. Players can choose to retrieve or remove from play the first part of their initial bet, or leave the first part in play or at risk, based on the value of the three cards in their hand. The side wager or bonus wager cannot be withdrawn and is immediately withdrawn by the house in the play of the game. The dealer then turns over one of the dealer's cards and the dealer's query is repeated with regard to the second part of the initial bet. Players can choose to retrieve or remove from play the second part of their initial bet or leave the second part in play or at risk, based on the value of the four cards consisting of the three cards in the player's hand and the exposed dealer's card. Players have no option with the third part of the bet. Finally, all cards are shown and the payouts and collections are resolved according to the ranking of the poker hand of each player, i.e., the players are not playing against each other or the dealer.

Another element of play in casino games and particularly casino table card games in the wagering structure. There are a multitude of card games that are based on one or more decks of conventional playing cards. Among the most popular of these games is poker, wherein a player's fortunes are determined by a well-known hierarchy or hierarchies of card combinations. Card games that are variants of poker are also very popular, such as Let It Ride® stud poker, Caribbean Stud® poker, Three Card Poker® and the like. This is due, at least in part, to the basic nature of the underlying game itself, combining elements of both strategy and luck. Additionally, poker-variants allow an existing player-base to capitalize on their preexisting knowledge of a game and to apply that knowledge in novel settings. The two most popular forms of traditional poker are draw poker and stud poker.

In a conventional hand of draw poker, a standard, single 52-card deck of shuffled playing cards is used. Each player begins a hand by contributing an initial or "ante" bet to a common pool or "pot", the pot ultimately going to the owner of the single winning hand. The dealer then distributes five face-down cards to each player, the remaining cards in the deck being set aside for later use. Each player evaluates the cards that he or she has been dealt and each, in turn, is given an opportunity to discard one or more cards from the dealt hand. The dealer gives the player replacement cards for those that have been discarded by dealing additional cards face-down from the top of the deck. Following the deal, one or more rounds of betting take place, during which time each player may make an initial raise, a check wager, fold (drop-out), match a previous raise or raise a previous bet. These wagers are all added to the pot. The meanings of these wagering terms are well known to those skilled in the art and typical definitions of same may be found in, for example, *Hoyle's Rules of Games*, pp. 75-102, by Morehead and Mot-Smith, 1963, the disclosure of which is incorporated herein by reference. At the conclusion of the wagering rounds, the players display their hands and the holder of the highest ranking poker hand takes all of the money in the pot.

Stud poker is the most popular form of "open poker," wherein each player is dealt some cards that are face-up and, hence, available for viewing by the other players. Stud poker comes in two varieties: 5-card and 7-card, the two being of approximately equal popularity. In five-card stud poker, the dealer gives each player a face-down (or "hole" card) and then a face-up card. Thus, at the start each player knows his own two cards and one card of each of his opponents. After the first two cards are dealt, a wagering round ensues, during which time each player contributes his or her wager to the pot. A typical description of the rules that govern this round might be found in, for example, Hoyle's Rules of Games, pp. 75-102, by Morehead and Mot-Smith, 1963, the disclosure of which is incorporated herein by reference. After the wagering round, another card is dealt face-up to each player. This is followed by another wagering round. Alternating dealing and wagering rounds continue until each player has a total of five cards: four face-up and a concealed hole card. After the final bets have been placed, each player who has not dropped out during the deal/wager rounds reveals his or her hole card. The owner of the highest ranking 5-card poker hand wins and takes whatever amount is in the pot. Only the player with the highest ranking hand wins.

Seven-card stud poker differs slightly from 5-card poker. First, in 7-card poker each player initially receives two cards face-down and one card face-up. A bidding round then ensues. The dealer then gives each player another face-up card, which is followed again by a bidding round. Deals (of one face-up card) and bids are alternated until each player has four face-up cards and two face-down cards. Finally, a third face-down card is dealt to each player (making a total of seven cards). This is followed by a last bidding round. The winner of the hand is the player who can form the highest ranking 5-card poker hand from his seven cards.

As is well known to those skilled in the art, five-card poker hands are ranked from "Royal Flush" (highest) to "High Card(s) in Hand" (lowest) according to the following ordering:

| Hand | Description | Example |
|---|---|---|
| Royal Flush | The five top cards of a suit | A, K, Q, J, 10 (suited) |
| Straight Flush | Five cards in sequence in the same suit | 5, 6, 7, 8, 9 (suited) |
| Four of a Kind | Any four cards of the same rank | 2, 2, 2, 2, J |
| Full House | Three of a kind and a pair | 2, 2, 2, J, J |
| Flush | Five cards of the same suit | 2, 4, 8, 10, A (suited) |
| Straight | Five cards in sequence | 6, 7, 8, 9, 10 (unsuited) |
| Three of a Kind | Three cards of the same rank | 2, 2, 2, 9, J |
| Two Pair | Two cards of the same rank and two others of a different rank | 2, 2, Q, Q, A (unsuited) |
| One Pair | Two cards of the same rank | 9, 9, 5, 8, K |
| High Card(s) in Hand | Five unmatched cards | A, 9, 5, 3, 2, (unsuited) |

In some variations of poker, the ace may also act as the lowest card in the deck to form a straight when used in a sequence like A, 2, 3, 4. Additionally, a "wild card"—often the "joker" card may be designated, so that a person who holds that card may declare its value to be that of any card in the deck, the presumption being that the declared card value will help that player form a better poker hand.

At its core, poker is a vehicle for gambling. Commonly the quantities wagered are monetary, but that is not strictly required and poker chips, matches, and other non-pecuniary tokens have been used in place of money to help the players determine who is winning without exposing them to financial loss. Of course, casinos are in the business of providing people with the opportunity to gamble and, given the popularity of poker among the general populous, it only stands to reason that casinos would desire to offer this game in some form or another to those who seek to play it. However, conventional-rules poker is not particularly well suited for use in a casino.

A casino that offers traditional poker to its clientele typically does so by providing a dealer and a room in which to play, but the casino's dealer does not actually participate in the game as a player. His or her function is just to distribute the cards and referee the game. The casino makes its money by taking some percent of all of the money wagered (the "rake") or by leasing the room to the participants. The cost of the lease may be measured in time (e.g., a fixed amount per hour) or by a count of the number of hands played. Traditional poker games are not particularly favored by casinos because the casino does not make as much money acting as a landlord as it would if it were an active participant in the game. Similarly, from the standpoint of the gaming public, traditional poker has some disadvantages that have tended to make it less desirable as a casino game. First, traditional poker is readily available "at home," e.g., at the Friday night poker session, and there is no particular need for most people to travel to a casino to play it. Second, when an individual wins at traditional poker it is at the expense of the other players/participants. Many people prefer to play against the more impersonal "house" (i.e., the casino) so that their winning hand does not necessarily result in a loss by a fellow player, who may be an acquaintance. Finally, traditional poker does not offer the excitement associated with "jackpot" type games. That is, a royal flush in traditional poker—as improbable as that card combination is—will result in winning only the amount in the pot and nothing more. Many players seek out games where there is some possibility of "winning big," an option that is not available under conventional poker rules.

As a consequence of these disadvantages, casinos have introduced a variety of poker-type game variants to address the shortcomings discussed previously. One obvious advantage of these poker-type games from the casino's point of view is that the casino becomes an active participant in the game (as the house) and can, as a consequence, increase the revenue earned with the game. Additionally, these poker-type games are very attractive to many of the gambling public, and the mere fact that they are available in a particular casino has the potential to increase consumer traffic and revenue there.

A variety of innovative strategies have been employed to make poker-type games more appealing to casino gamblers. For example, many poker-variants are designed to let the players compete against the house, rather than against each other. In other cases, progressive betting has been utilized, wherein the player may increase his or her bet during the play of a hand. This makes the game more exciting to the player and potentially more profitable for the casino. Jackpots have been introduced, wherein certain card combinations in the player's hand result in an enhanced payout to that player. Finally, computer implementations of these games is always an attractive possibility, with video based casino games becoming increasingly popular. One such video implementation of a poker-type game is taught by Weingardt, U.S. Pat. No. 5,042,818. Of course, a natural next step is to offer these same video based casino games over the Internet, thereby making the games available to a potentially enormous audience. The most successful casino table poker games to date are Let It Ride® stud poker (as originally described in U.S. Pat. No. 5,288,081), Caribbean Stud Poker® (originally described in U.S. Pat. No. 4,836,533), and Three Card Poker® (as described in U.S. Pat. No. 6,237,916).

In most casinos, a game of blackjack begins by having each player place an initial wager. The blackjack dealer then distributes two cards face-down to each player and two cards-one face up and another face down-to him or herself. After the player has examined the two dealt cards and compared those cards with the face-up dealer's card, a number of options present themselves to the player. The player may "stand" (i.e., take no further cards), draw one or more additional cards in order to increase the numeric sum of the hand, double down (a form of progressive wagering), or split the two cards.

Additionally, if the dealer's face-up card is an ace, the player may elect to buy insurance against the possibility that the dealer has a blackjack. If, after the dealer's face-down card is revealed, the dealer does not have a blackjack, the player loses the amount that was paid as insurance (although he or she may go on to ultimately win that deal). If, on the other hand, the dealer has a blackjack, the player collects double the amount of insurance bought (but may still lose the amount of the original wager). The option of purchasing insurance is unique to blackjack type games and has not, heretofore, been available in poker-style games. The broad rules of blackjack are generally known to those skilled in the art and a fuller description may be found in the materials previously incorporated by reference.

In addition to novel games being introduced into casinos, novel betting formats have also been introduced. Side bets have always been common in wagering environments, but the use of side bets for jackpots and bonuses in casino table card games was believed to have been first practiced by David Sklansky in about 1982 in a public showing of Sklansky's Poker in Las Vegas, Nev. The play and/or betting structure of Caribbean Stud Poker® was modeled after that game. Blackjack has allowed surrender play at many tables, where half the original wager is withdrawn and the other half is forfeited to the house at the election of the player. U.S. Pat. No. 5,820,460 (Fulton) describes a method for playing a casino table card game wherein wagers are changed after some cards are viewed by the player. Let It Ride® stud poker advanced that theory significantly as described in U.S. Pat. No. 6,273,424, where specific segments of wagers could be withdrawn from an original wager that was made in multiple parts.

All of this background art is incorporated herein by reference in its entirety to provide technical knowledge on how images can be combined and integrated for display in the gaming device imaging system described in the practice of the present invention.

SUMMARY OF THE INVENTION

A multi-player automated casino table card game platform enables play of casino table poker-type games according to rules effected through a processor. Rules may include games similar to Let It Ride® stud poker such as playing a wagering game comprising a player placing a wager comprising at least two distinct parts and providing to the player at least a portion of the player's game elements so that partial information or a game outcome is provided; giving the player at least one opportunity, before the player's final game outcome is determined, to withdraw from engagement in the game at least one part of said at least two parts, but less than all of said at least two parts, and continuing play of the game with additional portions of the player's game elements being displayed to the player.

DETAILED DESCRIPTION OF THE INVENTION

Figure 1:
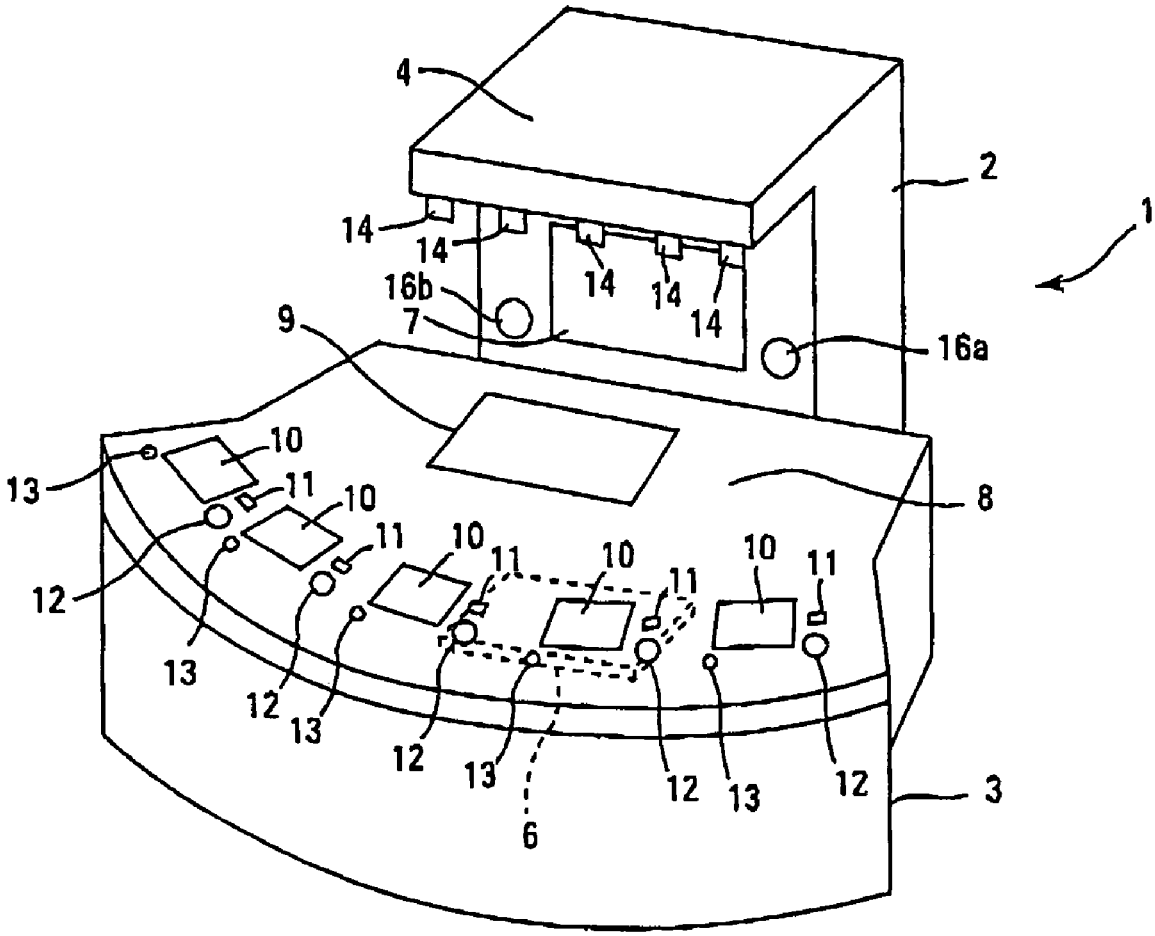
Fig. 1 Prior Art
FIG. 1 shows a perspective view of a prior art format for an automated gaming system.

The games of the present invention may be implemented as a game offered on a multiple player interactive video platform, as a live table games, television or cable game show games, video poker gaming machine platforms, hand-held games for play, multiple player interactive wagering platform games (with kiosk formats, single player screens, community screens, and/or banks of seats for players with a common dealer screen), cell phone games, games downloadable from the internet, parlor games, games executed on personal computers, palm pilots, play stations and the like. Each of the above game applications is contemplated by the present invention.

The game method of the present invention comprises each player placing an initial, three or more part wager, and preferably a four-part wager (as opposed to the required three-part wager used in Let It Ride® stud poker) to participate in the game. Cards are dealt by a dealer. In one example, three cards are dealt face down to each player and two cards are dealt face down to the dealer. Players inspect or "sweat" their cards, and the dealer asks, "take it or leave it?" or "Let It Ride®?" with regard to the first part of the initial bet. Players can choose to retrieve or remove from play the first part of their initial bet, or leave the first part in play or at risk, based on the value of the three cards in their hand. The dealer then turns over one of the dealer's cards and that card is considered a part of each player's hand. The dealer's query is repeated with regard to the second and third parts of the initial bet. Players can choose to retrieve or remove from play the second part or leave the second part at risk, based on the value of the four cards consisting of the three cards in the player's hand and the first exposed dealer's card. Players have no option with the third part of the bet, which is referred to as the contract wager, as it must remain in play through the conclusion of play of the game. Finally, all cards are shown and the payouts and collections are resolved according to the ranking of the poker hand of each player, i.e., the players are not playing against each other or the dealer.

Several variations in the game are contemplated by the present invention. For example, four wagers rather than three may be placed. The player has the option to withdraw his first bet. He also has the option to withdraw a second bet but if he withdraws the second bet, the third bet is swept by the house. The fourth bet is the contract bet and cannot be removed by the player. Similarly, the player could place three or five bets, with a number of bets having the interdependency of that of the second and third bets in the above example. What is meant by "interdependency" for purposes of this disclosure is that when any bet, except the contract bet is withdrawn by the player, another bet is automatically forfeited to the house.

The game play could be similarly modified, allowing the players and dealer more or less cards. What is important to the invention is that the player receive partial information about his hand, and then be given at least one opportunity to withdraw a portion of his bet, resulting in an automatic forfeiture of another portion of this bet as a result of the decision to withdraw.

The pay table in the four-part wagering game (to be marketed as "Dakota Stud™" table card game) can be adjusted from the pay tables in Let It Rides® poker to reflect the change in betting/wagering structure. For example, to compensate for the required forfeit of the third wager part if the second wager part is withdrawn, the qualifying hand for a win may be lowered from the pair of 10's ordinarily required to win against the pay table in Let It Ride® stud poker. For example, the minimum winning hand may be any pair, a pair of 2's, 3's, 4's, 5's, 6's, 7's, 8's or 9's. Additionally, higher odds may be paid on higher ranked hands to make play of the game more attractive to players. The game may also be modified to provide the player with five cards and the dealer with two hole cards or common cards, with the best five-card poker hand playing against a pay table, or with the player being dealt four cards, and the dealer receiving three cards. This may be done with the dealer having one of the three cards exposed immediately before consideration of withdrawal of the first part of the wager, or with three cards provided face down. In the latter circumstance, the dealer's face down cards may be exposed one-at-a-time, or preferably two at one time and one card at another time in the betting/wagering sequence. Two cards may be exposed before consideration of withdrawal of the second (and third) parts of the wager, or first one card exposed at this stage and then two cards exposed at the end of play, after withdrawal of the second and third parts has been considered and exercised.

In one preferred play of the game, the initial wager placed by each player comprises four equal parts and is made or placed before any cards are dealt. Each player is dealt three cards face down in the customary fashion. Two common cards are dealt face down in front of the dealer for use by all of the players. Each player will use the two common cards in front of the dealer in combination with his or her three cards to create a five-card hand. After all players have placed their four wagers/bets (and in an optional play of the game, a special bonus wager or jackpot wager for extra or extraordinary awards for high ranking hands against a pay table) and received and examined their cards, each is given the opportunity to retrieve one part (if equal wagers are placed, that is one-fourth) of the initial wager before the dealer reveals one of the two down cards previously placed in front of him. After all of the players have been queried and decided whether to withdraw the first part of their wager, the dealer turns one of the down cards face up. Each player now has the benefit of four cards, the three he or she is holding down plus the common card, and the dealer again gives each player the opportunity to retrieve further part(s) of the initial wager. In this case, with equal wagers, the player has the option of leaving the second and third parts in play or withdrawing the second part and forfeiting the third part before exposing the second common down card. After the second common down card is revealed, the players turn up the three cards they are holding thereby forming five card hands made up of the three cards dealt to each player and the two dealer cards. The dealer examines each of the players' hands and determines what payout, if any, each player is entitled to receive according to that players' remaining wager and a preselected payout schedule. Payouts are made to players with winning hands and the losing wagers are collected. The cards are then reshuffled for the next hand. Where a separate side bet has been placed as a bonus or jackpot wager (against a pay table and/or against a progressive jackpot), that wager must also be resolved.

In addition to the play of the basic game of Let it Ride® or a similar game with an altered betting structure, additional features can be added to increase player enjoyment and anticipation.

For example, a side bet could be placed on the occurrence of the player holding one of a predetermined number of winning bonus hands. The bonus hands can be displayed on the gaming table layout in the form of a pay table, showing the various winning hands and corresponding payout odds.

In one preferred form of the bonus game, the bonus hand rankings are a subset of winning base game hand rankings. However, the payouts on the bonus hand are much higher. A typical base game and bonus game pay table is reproduced below:

| Hand | Base Game Odds | Bonus Game Odds |
|---|---|---|
| Royal Flush | 1000 | 20,000 |
| Straight Flush | 200 | 2,000 |
| Four of a Kind | 50 | 150 |
| Full House | 11 | 75 |
| Flush | 8 | 50 |
| Straight | 5 | 9 |
| Three of a Kind | 3 | 9 |
| Two Pair | 2 | 9 |
| Pair of 10's or better | 1 | 0 |

As can be seen from this exemplary pay table, the bonus game winning outcomes is a subset of the winning outcomes of the base game. Typically, the bonus game winning hands are a subsest of the base game winning hands. If a player were to place a side bet and receive four of a kind, he would be paid 50:1 on all of the first three wagers that remain at risk in the game plus he would receive an additional payout of 150 (150× the $1.00 side bet).

The exemplary pay table assumes that all wagers made are returned to the player when the player has a winning hand. In another version of the invention, once a bet has been wagered, the house takes the bet as is conventional with video poker, for example. If the player wins a credit of one, he loses his original credit, and wins a credit. The player is therefore paid one for one on the bet. This is in contrast to the betting structures of live table games and one preferred form of the video simulation, where the players do not automatically lose control of the bets on the table. If a player places a wager of one dollar and wins one to one, he is paid one dollar on the bet, plus his wager is returned.

In other forms of the game, an additional bonus side bet may be paid. This side bet may be offered in combination with or as a replacement for the above-identified side bet. In the second optional side bet, the player makes a wager on the occurrence of a predetermined winning three-card poker hand, the hand formed from the player's initially dealt first three cards. If the player hand is one of the predetermined numbers of combinations, the player wins an additional payout according to a pay table printed on the layout. An example of one such three-card poker side bet is provided below:

| Hand<br>Hand | Three Card Poker Side Bet Odds<br>Three Card Poker Side Bet Odds |
|---|---|
| Royal Flush | 50 to 1 |
| Straight Flush | 40 to 1 |
| Three-of-a-kind | 30 to 1 |
| Straight | 6 to 1 |
| Flush | 4 to 1 |
| Pair | 1 to 1 |

Other side bets, such as a fixed amount side bet on a progressive jackpot could also be combined with the base game, as well as a poker-style pot bet or other type of bet. In one example of the invention, the player makes three equal bets to participate in the underlying game and one, two or three optional side bets on the occurrence of a predetermined five card poker hand with corresponding payout odds, a predetermined three card poker hand with corresponding payout odds or a predetermined hand that entitles the player to a fixed amount, payout odds, a portion of a progressive jackpot or all of a jackpot. In yet another example of the invention, the player is entitled to a fixed jackpot amount or a randomly determined jackpot bonus award. The award can also be in the form of goods and services and is not limited to payment of currency or credits.

Apparatus is disclosed for playing the wagering game according to the method outlined above. A typical gaming table, with a playing surface, is modified to include specific areas that provide locations for placing the wagers and for displaying the common cards. A card shuffling machine such as that disclosed in U.S. Pat. No. 4,807,884 or other shuffling machines manufactured by Shuffle Master Gaming, Inc. of Las Vegas, Nev. for facilitating and speeding the play of the wagering game may be used. A display device may be associated with the apparatus for displaying game information, shuffle status, or other information relevant to the dealer, the players or the house.

The present invention provides an exciting and interesting wagering game. The wagering game is easy to learn, largely being based on five-card stud poker and the well known ranking of five card poker hands. The present invention provides a new variation of a well known wagering game, five card poker, and in particular Let It Ride® stud poker, which is made more interesting by providing the opportunity for players to make multiple wagers and decisions related to those wagers based on the progress of the game.

Still another aspect of the present invention is to provide a wagering game that is easy to learn, yet demands skill of players in making strategic decisions about whether to withdraw a portion of the bet. It is yet another aspect of the present invention to provide a unique, exciting card game for play in casinos or at home and on various media including casino tables, video poker machines, video lottery terminals or home computers. It is an advantage of the game of the present invention that wagering decisions are inherent in the game. The game enhances players' sense of participation and takes advantage of players' inclination to keep wagers at risk once placed. The interdependency of at least two bets further encourages players to let bets remain at risk.

A gaming system that can be used to practice the method of the present invention comprises a table and a dealer "virtual" video display system positioned for view by players seated at the table. The table may seat at least two players up to the amount of players that can be configured about the table and have a view of the dealer video display system. Typically each gaming system will have at least four player available positions, with space determinations considered as to whether there would be 4, 5, 6 or 7 player positions. It is possible to have a completely circular dealer display (e.g., holographic display in a cylindrical centerpiece) and have players distributed around the entire periphery, but this is too dissimilar to standard play arrangements and could slow the game down, as play should approximate that of a live game, with players sitting together and playing in sequence. A surface of the table will include a generally continuous display screen on the surface for showing all player hands, community cards, dealer hands and any other cards used to play the game for any purpose, and, touch screen player controls or conventional push button controls. A majority of the table surface comprises a video monitor in one example of the invention. Where there are no touch screen controls, the table surface may include player control panels at each player station near the continuous display screen. The use of a continuous display screen offers some significant advantages in simulating or recreating a standard card table surface. Cards may be readily viewed by other players at a table, which is standard in table games and adds to player enjoyment. Individual monitors, especially where slanted towards the individual players make such table-wide card reading difficult. The use of the full screen (continuous) display also allows for better animation to be provided, such as displaying virtual images of cards moving to the player and "virtual" chips being placed on the table when wagers are indicated. For purposes of this disclosure, the term "virtual" means a graphical video representation of a real object or person, such as a dealer, cards and chips, for example.

The individual player positions preferably have a separate intelligence at each player position that accepts player input and communicates directly with a game engine (main game computer or processor). The intelligence is preferably an intelligent board that can process information. For purposes of this disclosure the term "intelligent" refers to the ability to execute code, either provided in the form of software or hardware circuits. Such processing may at least comprise some of signal converting (e.g., signals from player card readers, credit deposit, currency readers, coin readers, touch screen signals, control panel signals) into a signal that can be included in an information packet and interpreted by the main game computer when the signal is sent. Communication between the intelligence at each player position is direct to the main game computer and may be by self-initiated signal sending, sequenced polling by the main game computer (e.g., each position communicates directly to the main game computer in turn), timed communication, or any other order of communication that is direct between the intelligence and the main game computer.

One preferred form of communication between the main game computer and player station computers is by means of self-initiated signal sending. There is essentially a single main game computer that contains video display controls and programs for both the dealer display and the table top display, audio controls and programs, game rules (including storage of multiple games if intended to be available on the machine), random number generator, graphic images, game sequence controls, security systems, wager accounting programs, external signaling and audit functions, and the like. In other forms of the invention, the above functions are divided between a main processor and one or more additional processors. The intelligence at each player position speeds up the performance of all aspects of the game by being able to communicate directly with the main game computer and being able to process information at the player position rather than merely forwarding the information in raw form to the main game computer. Processing player information at player positions frees up resources for use by the main processor or processors.

A card game system may also include a suitable data and control processing subsystem that is largely contained within a main control module supported beneath the tabletop. The control and data processing subsystem includes a suitable power supply for converting alternating current from the power main as controlled by a main power switch. The power supply transforms the alternating line current to a suitable voltage and to a direct current supply. Power is supplied to a power distribution and sensor/activity electronics control circuit. Commercially available power switching and control circuits may be provided in the form of a circuit board which is detachable, and plugs into a board receptacle of a computer mother board or an expansion slot board receptacle. A main game controller motherboard may include a central microprocessor and related components well-known in the industry as computers using Intel brand Pentium® microprocessors and related memory or intelligence from any other manufacturing source. A variety of different configurations and types of memory devices can be connected to the motherboard as is well known in the art. Of particular interest is the inclusion of two flat panel display control boards connected in expansion slots of the motherboard. Display control boards are each capable of controlling the images displayed for the dealer video display and for each of the player position display areas on the continuous display screen on the table and other operational parameters of the video displays used in the gaming system. More specifically, the display control boards are connected to player bet interfaces circuits for the player stations. This arrangement also allows the display control boards to provide necessary image display data to the display electronic drive circuits associated with the dealing event program displays and the dealer display.

The motherboard and/or the individual player intelligent boards also includes a serial port that allows stored data to be downloaded from the motherboard to a central casino computer or other additional storage device. In one example, each player board communicates directly with the casino computer system. This allows card game action data to be analyzed in various ways using added detail, or by providing integration with data from multiple tables so that cheating schemes can be identified and eliminated, and player tracking can be maintained. Player performance and/or skill can be tracked at one table or as a compilation from gaming at multiple tables, as by using Bloodhound™ security software marketed by Shuffle Master, Inc., which may be incorporated into this automated gaming system. Additionally, player hand analysis can be performed. The motherboard and/or individual player intelligent boards may also have a keyboard connection port that can be used to connect a larger format keyboard to the system to facilitate programming and servicing of the system.

Although the preferred system shown does not require features illustrated for receiving automated player identification information, such features can alternatively be provided. Card readers such as used with credit cards, or other identification code reading devices can be added in the system to allow or require player identification in connection with play of the card game and associated recording of game action by one of the processors. Such a user identification interface, for example a card reader located at each player station, can be implemented in the form of a variety of magnetic card readers commercially available for reading user-specific identification information. The user-specific information can be provided on specially constructed magnetic cards issued by a casino, or magnetically coded credit cards or debit cards frequently used with national credit organizations such as VISA, MASTERCARD, AMERICAN EXPRESS, casino player card registry, banks and other institutions. The information could also be provided on other writable media, such as an RFID chip with writable memory, or bar coding, as just a few examples.

Alternatively, it is possible to use so-called smart cards to provide added processing or data storage functions in addition to mere identification data. For example, the user identification could include coding for available credit amounts purchased from a casino. As further example, the identification card or other user-specific instrument may include specially coded data indicating security information such as would allow accessing or identifying stored security information which must be confirmed by the user after scanning the user identification card through a card reader. Such security information might include such things as file access numbers which allow the central processor to access a stored security clearance code which the user must indicate using input options provided on displays using touch screen displays. A still further possibility is to have participant identification using a fingerprint image, eye blood vessel image reader, or other suitable biological information to confirm identity of the user that can be built into the table. Still further it is possible to provide such participant identification information by having the pit personnel manually code in the information in response to the player indicating his or her code name or real name. Such additional identification could also be used to confirm credit use of a smart card or transponder. All or part of the functions dedicated to a particular player station are controlled by the player station intelligence in one form of the invention. Additionally, each player station intelligence may be in communication with a casino accounting system.

It should also be understood that the continuous screen can alternatively be provided with suitable display cowlings or covers that can be used to shield display of card images from viewing by anyone other than the player in games where that is desirable. This shielding can also be effected by having light-orientation elements in the panel, and some of these light-orientation elements are electronically controllable. In this manner, the processor can allow general viewing of cards in games where that is desirable or tolerated, and then alter the screen where desired. These types of features can be provided by nanometer, micrometer or other small particulate or flake elements within a panel on the viewing area that are reoriented by signals from the processor. Alternatively, liquid crystal or photo chromatic displays can be used to create a screening effect that would allow only viewers at specific angles of view from the screen area to view the images of cards. Such an alternative construction may be desired in systems designed for card games different from blackjack, where some or all of the player or dealer cards are not presented for viewing by other participants or onlookers. Such display covers or cowlings can be in various shapes and configurations as needed to prevent viewing access. It may alternatively be acceptable to use a player-controlled switch that allows the display to be momentarily viewed and then turned off. The display can be shielded using a cover or merely by using the player's hands. Still further it is possible to use a touch screen display that would be controlled by touch to turn on and turn off. Similar shielding can be used to prevent others from viewing the display.

A review of the figures will assist in a further understanding of the invention. FIG. 1 shows a fully automated gaming table 1 of the prior art, as disclosed in U.S. Patent Application 2003/0199316. The system 1 comprises a vertical upright display cabinet 2 and a player bank or station cluster arrangement 3. The vertical display cabinet 2 has a viewing screen 7 on which images of the virtual dealer are displayed. The top 8 of the player bank arrangement 3 has individual monitor screens 10 for each player position, as well and tabletop inserted coin acceptors 11, and player controls 12 and 13. There is a separate and larger dealer's hand screen 9 on which dealer cards are displayed in a format large enough for all players to view. Speakers 16*a* and 16*b* are provided for sound transmission and decorative lights 14 are provided.

Figure 2:
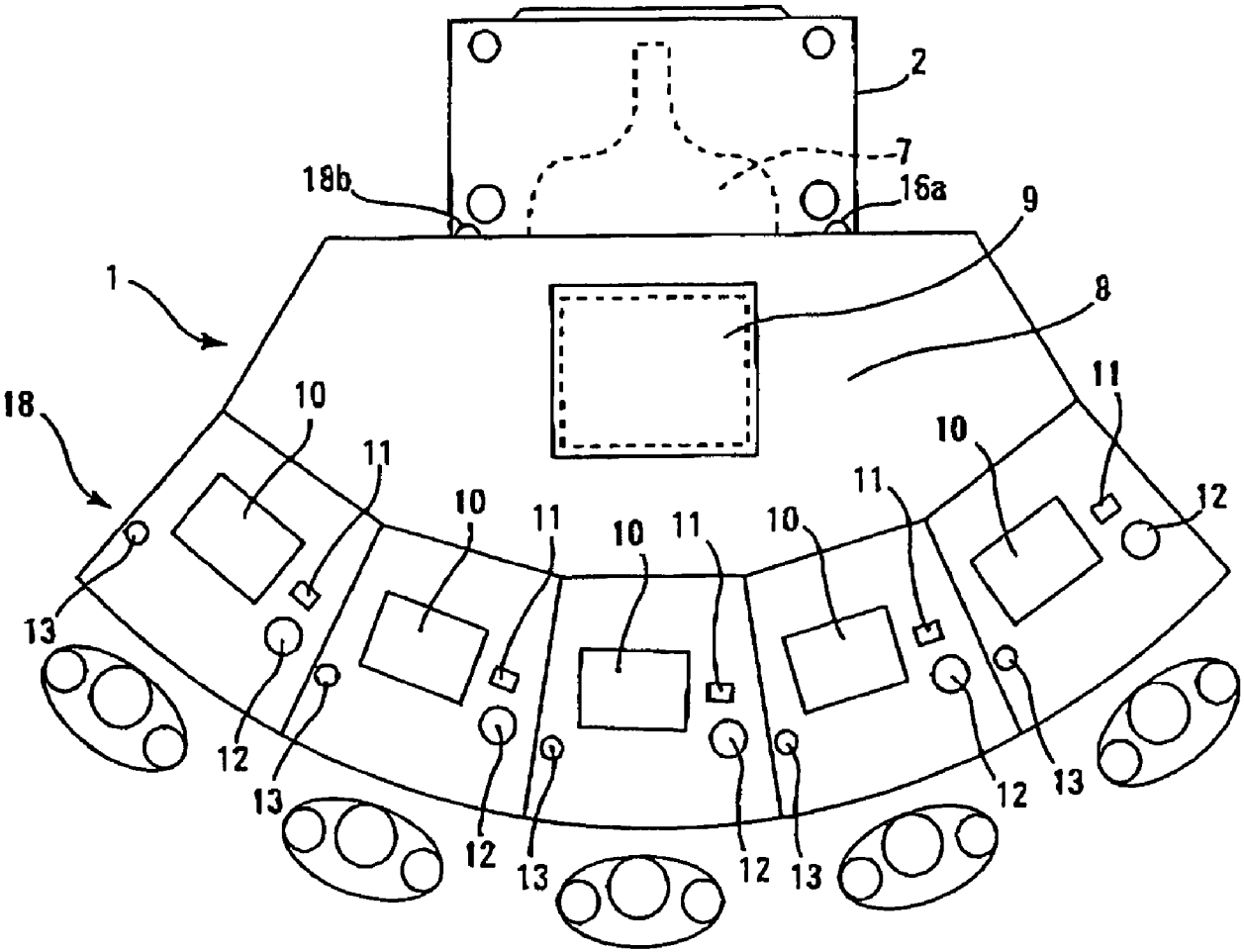
Fig. 2 Prior Art
FIG. 2 shows an overhead view of a prior art format for an automated gaming system.
Figure 3:
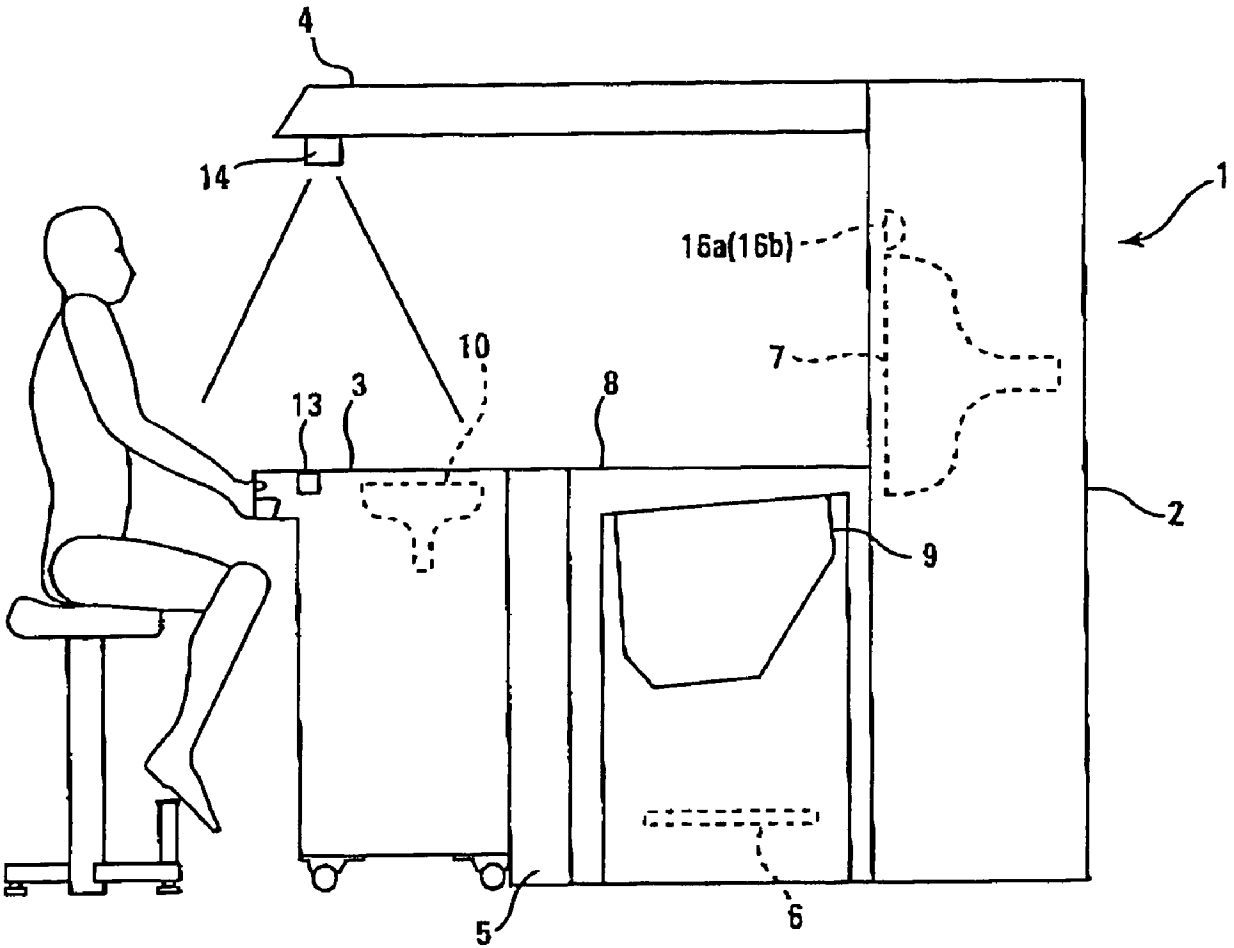
Fig. 3 Prior Art
FIG. 3 shows a side view of a prior art format for an automated gaming system.

FIG. 2 shows an overhead view of the same prior art automated gaming system 1 with the viewing screen 7 shown more clearly as a CRT monitor. It can also be seen that each player position has to form an arc cut into the semicircular player seating area 18. FIG. 3 shows a side view of the same prior art automated gaming system of FIGS. 1 and 2 where the orientation of the three different types of CRT monitors 7, 9 and 10 are shown.

Figure 4:
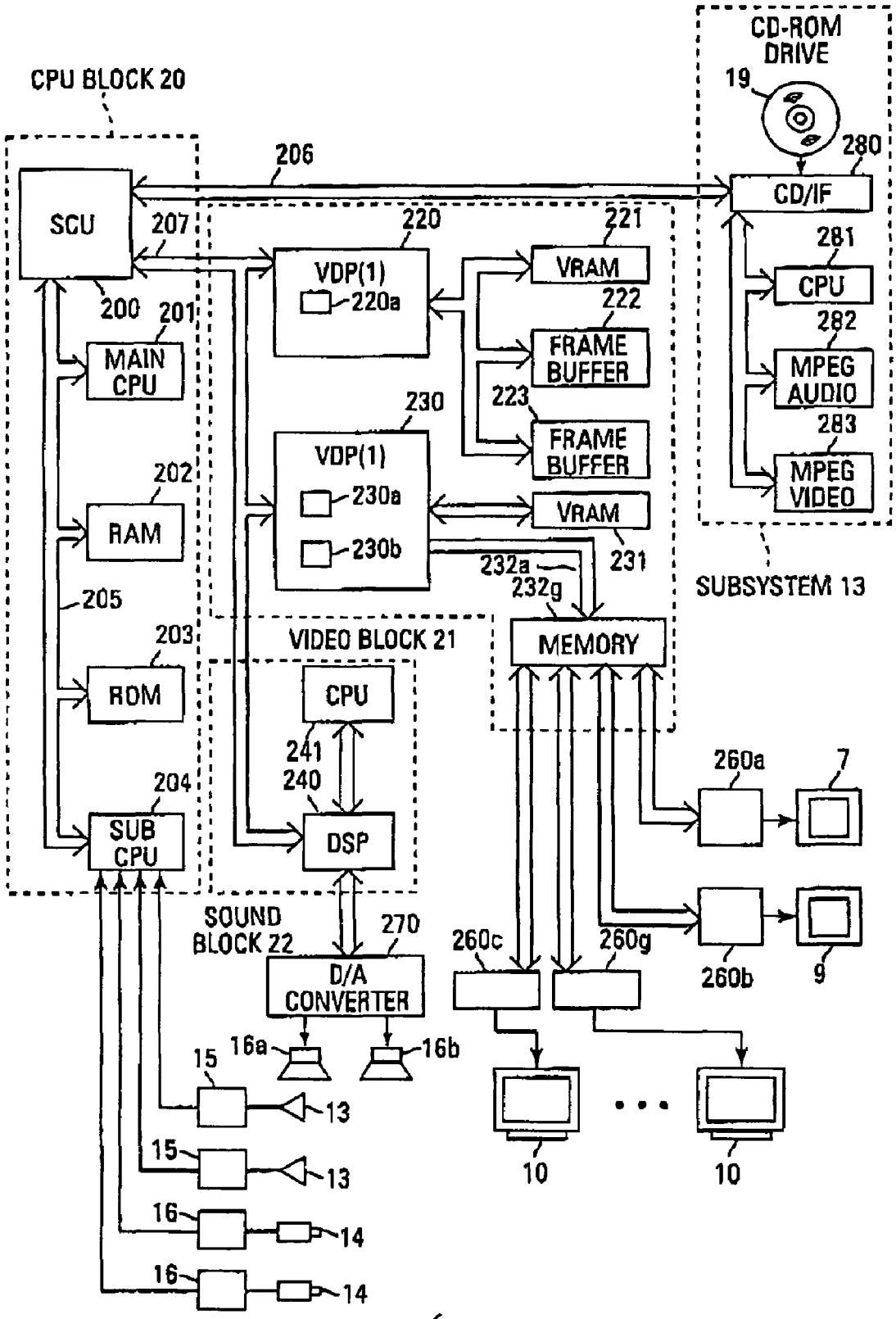
Fig. 4 Prior Art
FIG. 4 shows a block schematic of the electronic configuration of a prior art animated gaming system.

FIG. 4 shows the schematic circuitry of a prior art automated system as disclosed in 2003/0199316. FIG. 4 is a block diagram of processing circuitry in the game device of FIG. 1. The game device housing comprises a CPU block 20 for controlling the whole device, a picture block 21 for controlling the game screen display, a sound block for producing effect sounds and the like, and a subsystem for reading out CD-ROM.

The CPU block 20 comprises an SCU (System Control Unit) 200, a main CPU 201, RAM 202, RAM 203, a sub-CPU 204, and a CPU bus 205. The main CPU 201 contains a math function similar to a DSP (Digital Signal Processing) so that application software can be executed rapidly.

The RAM 202 is used as the work area for the main CPU 201. The RAM 203 stores the initialization program used for the initialization process. The SCU 200 controls the busses 205, 206 and 207 so that data can be exchanged smoothly among the VEPs 220 and 230, the DSP 241, and other components.

The SCU 200 contains a DMA controller, allowing data (polygon data) for character(s) in the game to be transferred to the VRAM in the picture block 21. This allows the game machine or other application software to be executed rapidly. The sub-CPU 204 is termed an SMPC (System Manager & Peripheral Control). Its functions include collecting sound recognition signals from the sound recognition circuit 15 or image recognition signals from the image recognition circuit 16 in response to requests from the main CPU 201. On the basis of sound recognition signals or image recognition signals provided by the sub-CPU 204, the main CPU 201 controls changes in the expression of the character(s) appearing on the game screen, or performs image control pertaining to game development, for example. The picture block 21 comprises a first VDP (Video Display Processor) 220 for rendering TV game polygon data characters and polygon screens overlaid on the background image, and a second VDP 230 for rendering scrolling background screens, performing image synthesis of polygon image data and scrolling image data based on priority (image priority order), performing clipping, and the like. The first VDP 220 houses a system register 220*a*, and is connected to the VRAM (DRAM) 221 and to two frame buffers 222 and 223. Data for rendering the polygons used to represent TV game characters and the like is sent to the first VDP 220 through the main CPU 220, and the rendering data written to the VRAM 221 is rendered in the form of 16- or 8-bit pixels to the rendering frame buffer 222 (or 223). The data in the rendered frame buffer 222 (or 223) is sent to the second VDP 230 during display mode. In this way, buffers 222 and 223 are used as frame buffers, providing a double buffer design for switching between rendering and display for each individual frame. Regarding information for controlling rendering, the first VDP 220 controls rendering and display in accordance with the instructions established in the system register 220*a* of the first VDP 220 by the main CPU 201 via the SCU 200.

The second VDP 230 houses a register 230*a* and color RAM 230*b*, and is connected to the VRAM 231. The second VDP 230 is connected via the bus 207 to the first VDP 220 and the SCU 200, and is connected to picture output terminals Voa through Vog through memories 232*a* through 232*g* and encoders 260*a* through 260*g*. The picture output terminals Voa through Vog are connected through cables to the display 7 and the satellite displays 10.

Scrolling screen data for the second VDP 230 is defined in the VRAM 231 and the color RAM 230*b* by the CPU 201 through the SCU 200. Information for-controlling image display is similarly defined in the second VDP 230. Data defined in the VRAM 231 is read out in accordance with the contents established in the register 230*a* by the second VDP 230, and serves as image data for the scrolling screens that portray the background for the character(s). Image data for each scrolling screen and image data of texture-mapped polygon data sent from the first VDP 220 is assigned display priority (priority) in accordance with the settings in the register 230*a*, and the final image screen data is synthesized.

Where the display image data is in palette format, the second VDP 230 reads out the color data defined in the color RAM 230*b* in accordance with the values thereof, and produces the display color data. Color data is produced for each display 7 and 9 and for each satellite display 10. Where display image data is in RGB format, the display image data is used as-is as display color data. The display color data is temporarily stored in memories 232*a*-232*f* and is then output to the encoders 260*a*-260*f*. The encoders 260*a*-260*f* produce picture signals by adding synchronizing signals to the image data, which is then sent via the picture output terminals Voa through Vog to the display 7 and the satellite displays 10. In this way, the images required to conduct an interactive game are displayed on the screens of the display 7 and the satellite displays 10.

The sound block 22 comprises a DSP 240 for performing sound synthesis using PCM format or FM format, and a CPU 241 for controlling the DSP 240. Sound data generated by the DSP 240 is converted into 2-channel sound signals by a D/A converter 270 and is then presented to audio output terminals Ao via interface 271. These audio output terminals Ao are connected to the input terminals of an audio amplification circuit. Thus, the sound signals presented to the audio output terminals Ao are input to the audio amplification circuit (not shown). Sound signals amplified by the audio amplification circuit drive the speakers 16*a* and 16*b*. The subsystem 23 comprises a CD-ROM drive 19*b*, a CD-I/F 280, and CPU 281, an MPEG-AUDIO section 282, and an MPEG-PICTURE section 283. The subsystem 23 has the function of reading application software provided in the form of a CD-ROM and reproducing the animation. The CD-ROM drive 19*b* reads out data from CD-ROM. The CPU 281 controls the CD-ROM drive 19*b* and performs error correction on the data read out by it. Data read from the CD-ROM is sent via the CD-I/F 280, bus 206, and SCU 200 to the main CPU 201 that uses it as the application software. The MPEG-AUDIO section 282 and the MPEG-PICTURE section 283 are used to expand data that has been compressed in MPEG (Motion Picture Expert Group) format. By using the MPEG-AUDIO section 282 and the MPEG-PICTURE section 283 to expand data that has been compressed in MPEG format, it is possible to reproduce motion picture. It should be noted herein that there are distinct processor for the CPU block, video block, sound block, CD-ROM drive and Memory with their independent PCU's. This requires significant computing power and still has dumb (no intelligence) player input components.

Figure 5:
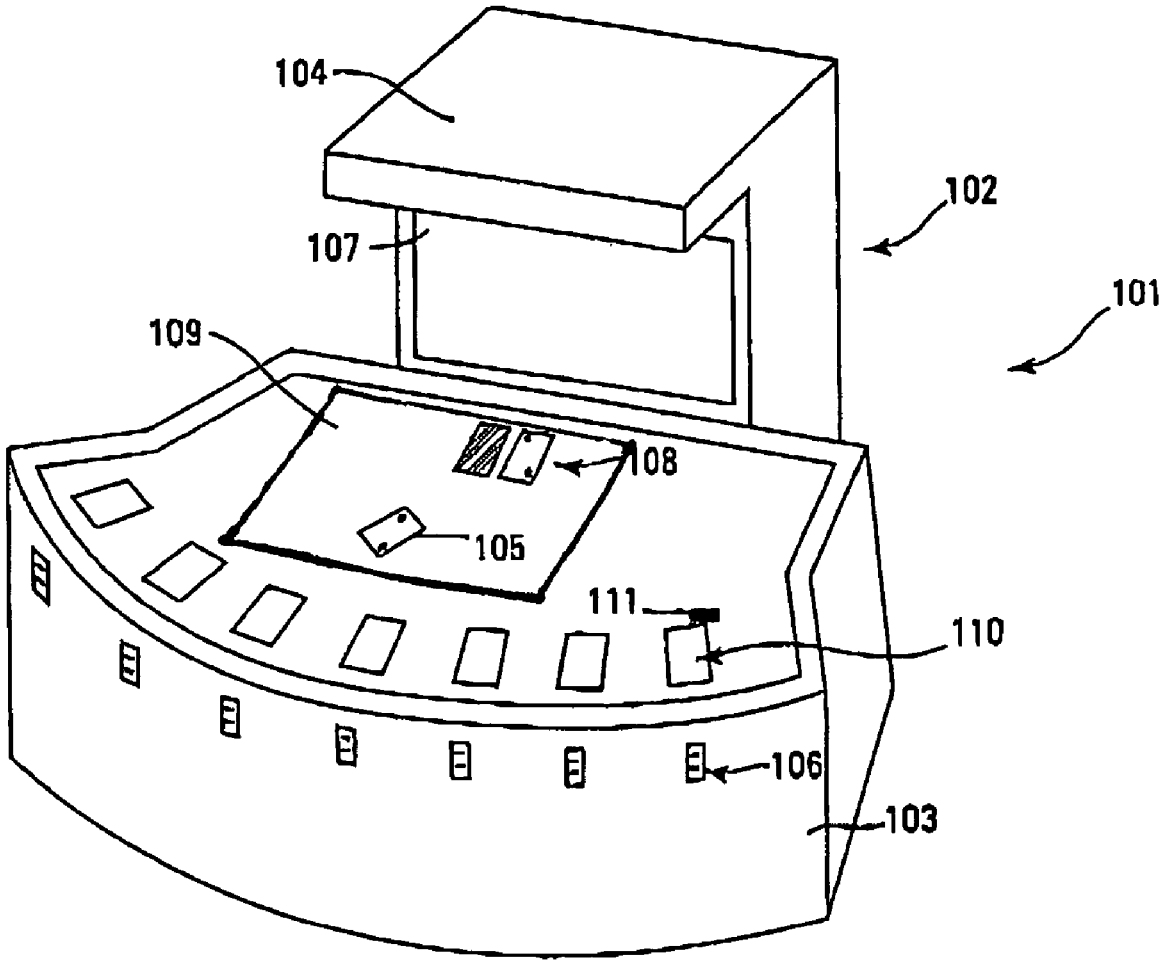
FIG. 5 shows a perspective view of a format for an automated gaming system according to the present invention.

FIG. 5 shows an example of an automated table system 101 useful to practice the game play methods of the present invention. The system 101 has an upright dealer display cabinet 102 with a top 104 and the dealer viewing screen 107 which may be any form of display screen such as a CRT, plasma screen, liquid crystal screen, LED screen or the like. The player bank arrangement 103 has a continuous display screen 109 on which images of cards being dealt 105, dealer's cards 108, bets wagered 111 and touch screen player input functions 110 are displayed. Other player input functions may be provided on a panel 106 which might accept currency, coins, tokens, identification cards, player tracking cards, ticket in/ticket out acceptance, and the like. Panel 106 may be located on the front of the player station or on a top surface of the player station.

Figure 6:
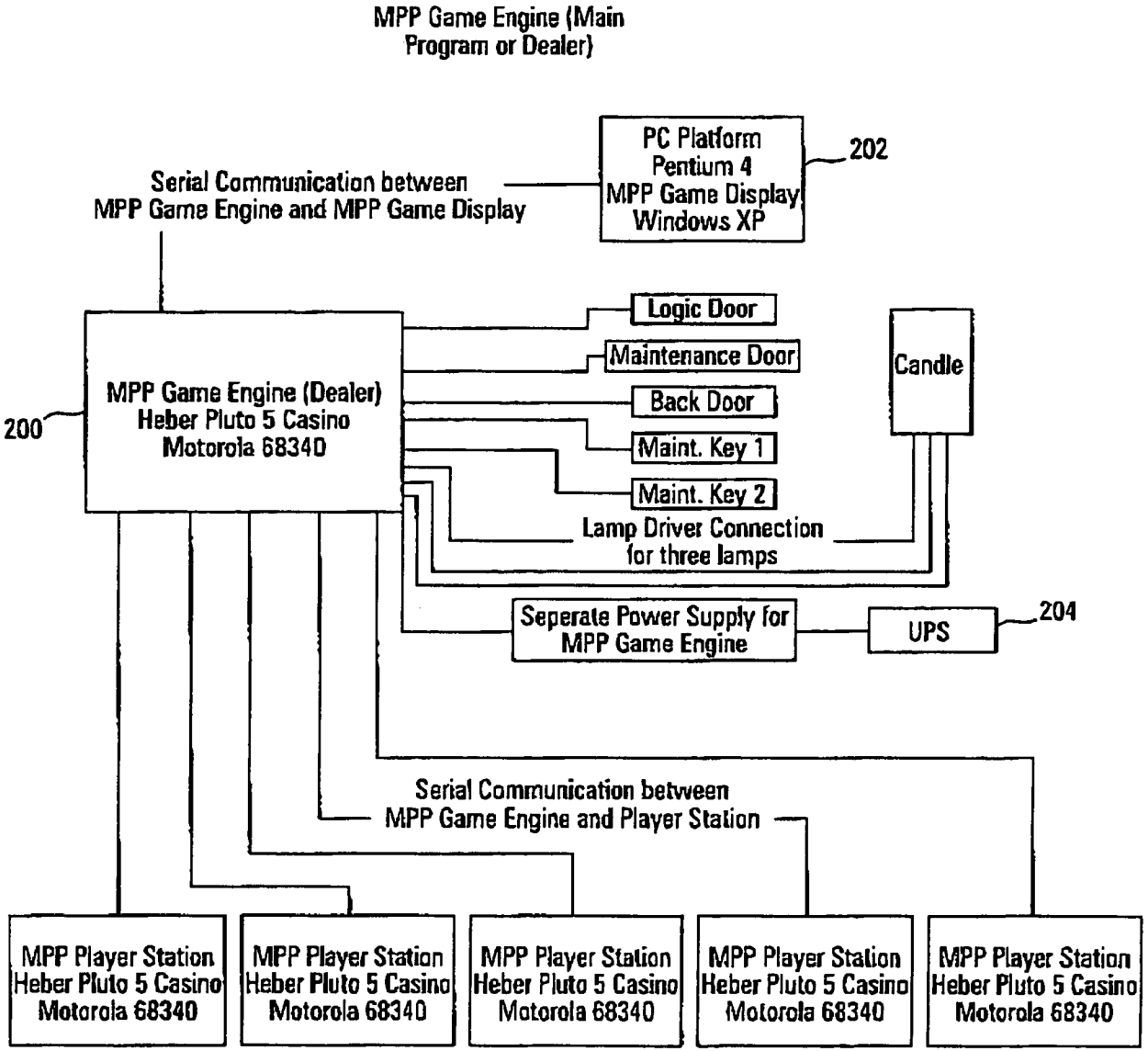
FIG. 6 shows a frontal view of a gaming engine useful in the practice of the present invention.

FIG. 6 shows an electronic/processor schematic for a MultiPlayer Platform (MPP) gaming system according to the presently described system. The MPP Game engine (dealer) comprises a Heber Pluto 5 casino game board 200 (Motorola 68340 board) operating off the PC Platform Pentium® 4 MPP Game Display processor 202. The game display processor operates on a Windows XP platform. The respective subcomponents on the Pentium 4 processor are labeled to show the apportionment of activity on the motherboard and the component parts added to the board. In another embodiment, the main processor 202 also controls the dealer display. As is shown, the game engine has an Uninterruptible Power Supply 204. The game display processor directs activity on the Speakers, directs activities onto the MPP Game Service panel, and the Plasma Monitor Card Table display. It is important to note that all communications are direct from the game display processor, freeing up resources available to the game engine processor.

Figure 7:
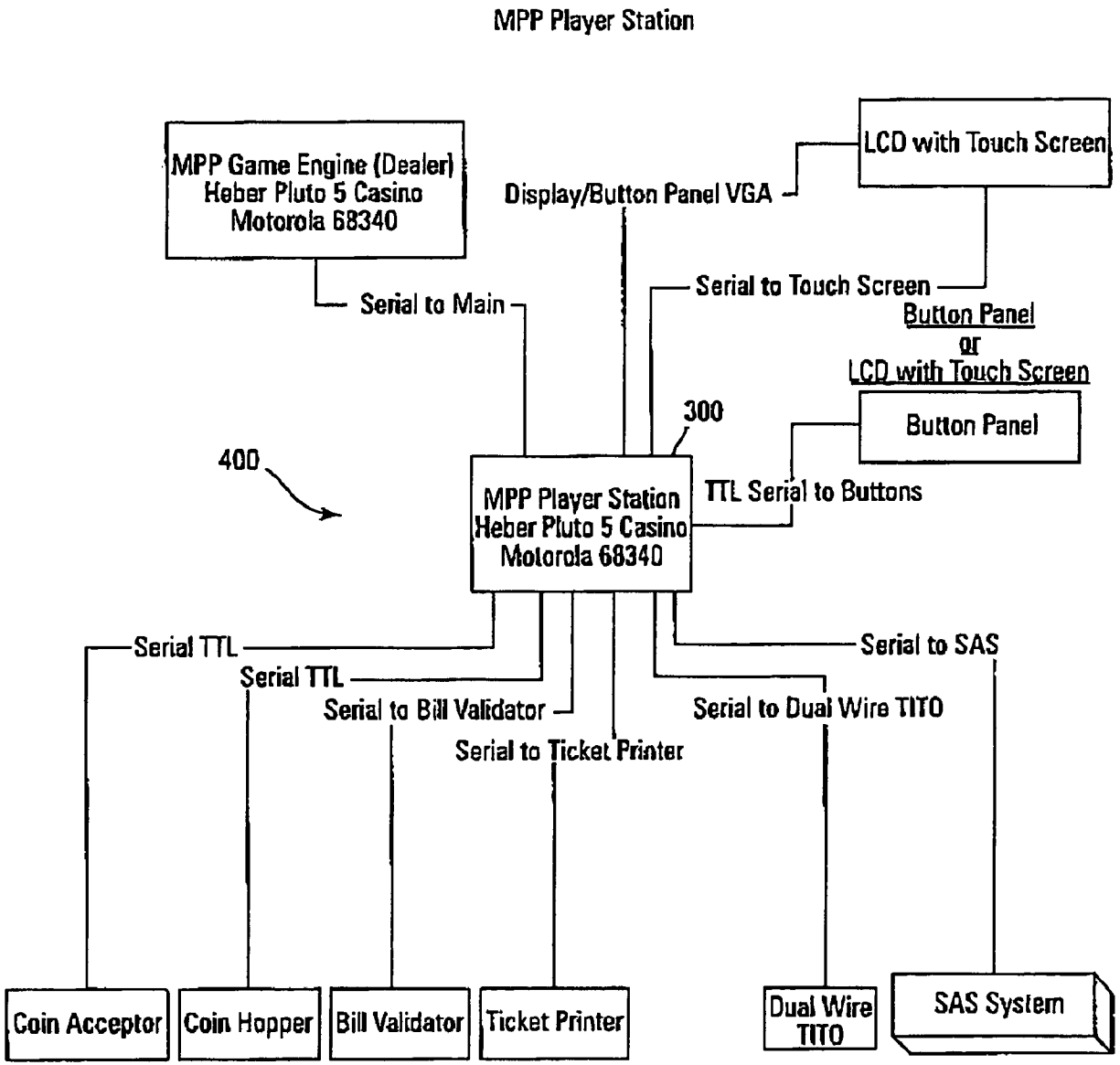
FIG. 7 shows a schematic of a player station useful in the practice of the present invention.

FIG. 7 shows the electronic/processing schematics of the MPP Player Station Intelligence board (Heber Pluto 5 Casino, Motorola 68340), each of which player stations (one for each player position) is in direct connection to the MPP Game Engine (Dealer), which is in turn directly connected to the PC Platform. (not shown in this Figure). Each Intelligence board receives information for all player input systems specific to that player station, such as the shown Coin Acceptor, Coin Hopper, Bill validator, Ticket Printer, Touch Screen and/or Display Button Panel, Dual Wire Ticket-in-Ticket-Out Printing and SAS System (SAS is one exemplary standard communications protocol used by a number of casinos central computer systems.) A significant benefit resides in the use of the independent Intelligence boards at each player position being in direct communication with the MPP Game Engine 300, as opposed to each individual player position button panel being dead or inactive until authorized by the main game processor, as previous automated gaming systems were constructed.

The above-described architecture is also an improvement in providing a system with not only the intelligence at each player position, but also in redistributing processing capability for functions among various processing components within the gaming system. In one architectural format, all functions of the gaming engine, except for the player localized intelligence functions, are consolidated into a single PC (e.g., the Pentium 4 shown in the Figures). This would include all game functions, player video functions, dealer video functions, dealer audio functions, security, central reporting (to a casino's central computer, for example), currency and debit functions, alarm functions, lighting functions, and all other peripherals on the system, except for the localized player functions. Alternatively, all functions requiring communication with the casino's main computer system are located on the player station intelligent boards. In this system, the main game processor would talk directly with the player intelligent boards, preferably in the same novel communication format described below.

Figure 8:
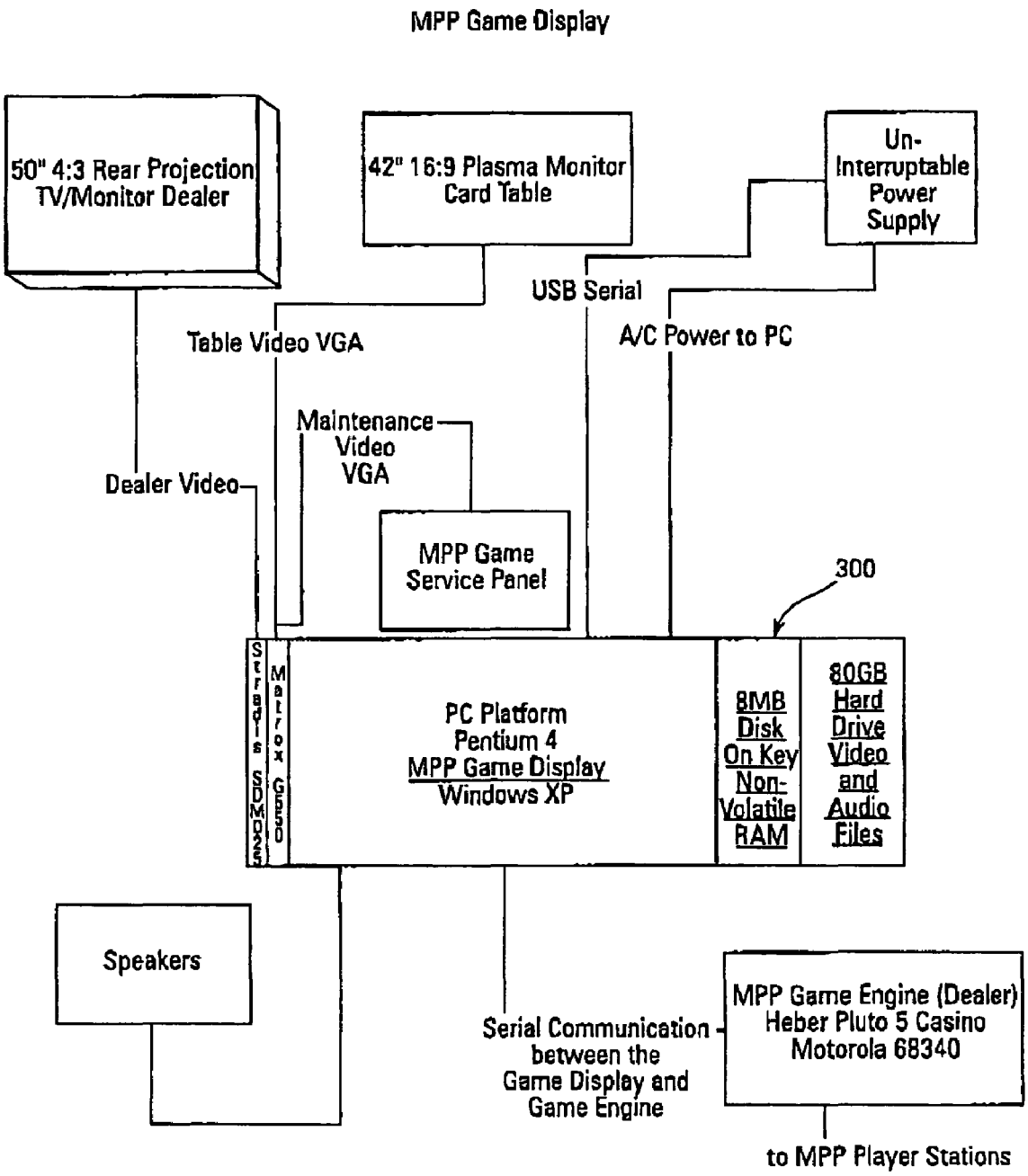
FIG. 8 shows a schematic of a preferred embodiment of a game display useful in the practice of the present invention.

An alternative system is shown in FIGS. 6, 7 and 8, where there is a dealer engine processor intermediate the main game PC and the Player intelligent boards. Both systems are a distinct improvement over the prior art, but with the higher power available for PC's, and with the ease of programming a PC as opposed to an embedded system, the consolidation of the game functions and the ability of the main game engine to communicate with each of the player positions is enabled. As shown in FIG. 8, the Game display processor 300 is preferably a Pentium® 4 PC and is separate from the main processor. With the player intelligent boards, the main game PC can receive packets of information from each player station as events occur rather than having to poll each player position on a regular basis 100 times to gain the specific information for each player input that may be made.

A description of the Heber Board, (an exemplary board that can be used as a player station processor and/or game engine processor 16) a commercially available intelligent processing board is as follows. The Heber Board is known for its reliability and flexibility, especially for the Pluto 5 family of gaming products. The Pluto 5 is the controller of choice for the global gaming industry. Flexibility comes from a set of features built into the Pluto 5 (Casino) controller, and from the choice of optional add-on boards that can be used to adapt the Pluto family to best suit individual applications. In the area of interfacing, there are three distinct boards, each of which serves a particular function in helping the Pluto 5 to connect with the world outside:

RS485 Board

RS485 is an industrial-grade board for linking multiple systems in unforgiving circumstances for centralized information gathering. The Heber RS485 board is fully opto-isolated to provide complete circuit safety when used within 'electrically noisy' environments. The RS485 board uses a single RS232 connection to the Pluto 5 board and all necessary power is also derived through this link. Two header connectors may be provided for the RS485 channel to allow daisy chain connections between multiple systems.

HII/ccTatk Board

This board specializes in communicating with industry standard note/coin acceptors and payout hoppers. Equipped with dual communication channels, each port is configurable to use either the HII format to connect with Mars® coin/note acceptors or the ccTalk format for Money Controls® hoppers. Both channels are controlled via a single RS232 connection to the Pluto 5 board and all necessary power is also derived through this link. The Heber FastTrack™ package contains modular library functions for passing information via these channels.

Four Channel Relay Board

The relay board allows control of medium- to high-level loads such as solenoids, without risk of damage or interference to the Pluto 5 circuitry. Four power-switching channels are available with absolute isolation from the Pluto 5 control signals. Each relay is capable of switching direct or alternating currents of up to 7A at a maximum voltage of 250V.

Like the Pluto 5 board itself, its modular options have been used extensively so that their designs are fully developed and entirely stable. The options that are specified are consistently provided in mass quantities. As with all Pluto products, programming for the modular options is straightforward. This is enhanced with the use of the Pluto 5 Enhanced Development Kit and also the FastTrack™ package. Between them, these kits contain all of the low level and high level programming tools and library functions needed for gaming applications. These systems can be provided through a Pluto 5 Enhanced Development Kit datasheet 80-15353-7 (Heber Limited, Belvedere Mill, Chalford, Stroud, Gloucestershire, GL6 8NT, UK Tel: +44 (0) 1453 886000 Fax: +44 (0) 1453 885013 www.heber.co.uk. Specifications for the various boards are identified below.

RS485 Interface

Host Interface
- RS232 connection to Pluto 5/Pluto 5 Casino
- All power provided via RS232 link from host system Communication Port
- Dual four-way Molex 0.1" KK headers for daisy chaining purposes Dimensions
- 80×61 mm(3.14×2.4")

Part Number
- Opto-isolated RS485 board
- 01-14536-2

HII/ccTalk Interface

Host Interface
- RS232 connection to Pluto 5/Pluto 5 Casino
- All power provided via RS232 link from host system Communication Port
- Single or dual 10 way header connectors Dimensions
- 101.6×69.85 mm (4×2.8")

Part Number
- Dual channel HII/ccTalk board
- 01-16171-2

Four Channel Relay Board

Host Interface
- Connection to Pluto 5/Pluto 5 Casino via ribbon cable using four standard output lines
- All power provided via ribbon cable link from host system Switching Capabilities
- Up to 250V AC or DC @ 7A maximum per channel Dimensions
- 80×61 mm(3.14×2.4")

Part Number
- Four channel relay board
- 01-15275-1
- 80-16949-1

One proposed hardware configuration uses a "satellite" intelligent processor at each player position. The player station satellite processor is substantially the same as the primary game engine processor, a Heber Pluto 5 Casino board. The satellite processors receive instruction from the primary game engine but then handle the communications with player station peripherals independently. Each satellite processor communicates with only the peripherals at the same player station. Thus each player station has a dedicated satellite processor communicating with only the peripherals at the same player station and with the casino's central computer system. The peripherals are, but not limited to: Slot accounting Systems, Bill Validator, Ticket Printer, Coin Acceptor, Coin Hopper, Meters, Button panel or LCD touch screen and various doors and keys.

The satellite processors run proprietary software to enable functionality. The player station software is comprised of two modules, the first being an OS similar to the game engine Operating System and the second being station software that handles peripheral communications. The software may be installed on EPROMs for each satellite processor. The primary method of communication between the satellite processors and the primary game engine is via serial connectivity and the previously described protocol. In one example, information packets are prepared by the satellite processors and are sent to the game engine processor on the happening of an event.

The proposed game engine provides communication to the player stations to set the game state, activate buttons and receive button and meter information for each player station. Communication is via a serial connection to each of the stations. The new protocol for communication between the game engine, game display and player stations is an event driven packet-for-packet bi-directional protocol with Cyclic Redundancy Check (CRC) verification. This is distinguished from the Sega system that used continuous polling. This communication method frees up resources in the same engine processor because the processor no longer needs to poll the satellites continuously or periodically.

The new protocol uses embedded acknowledgement and sequence checking. The packet-for-packet protocol uses a Command Packet, Response Packet and a Synchronization Packet as illustrated below. The protocol uses standard ASCII characters to send data and a proprietary verification method.

| Format of Command Packet | | | | | |
|---|---|---|---|---|---|
| STX | SEQ | DATA LENGTH | DATA | CRC-16 | ETX |
| 1 | 1 | 3 | 3-999 | 5 | 1 |

| Format of Response Packet | | | | |
|---|---|---|---|---|
| STX | SEQ | DSP | PRV | ETX |
| 1 | 1 | 1 | 1 | 1 |

| Format of Synchronization Response Packet | | | |
|---|---|---|---|
| STX | MTS | MRS | ETX |
| 1 | 1 | 1 | 1 |

| Legend For Figures | |
|---|---|
| STX | Start of Packet Character |
| SEQ | Sequence # (Cycles from '0' thru '9') |
| LEN | Length of Data Area ('003' thru '999') |
| DATA | ASCII Data Fields Separated with '\|' Character |
| CRC | CRC-16 Value ('0000' thru '65535') Cyclic Redundancy Check |
| ETX | End of Packet Character |
| DSP | Disposition Code ('A' ACK, 'N' NAK, or 'I' Invalid Sequence) |
| PRV | Sequence Number of Last ACK'ed Packet (0 thru 9) |
| MTS | Main's Current Transmit Sequence Number |
| MRS | Main's Current Receive Sequence Number |

The Command Packet and Response Packet are used during primary game communications. The protocol uses redundant acknowledgement. For example: The packet is initially acknowledged when first received by the recipient. The same recipient will resend anther acknowledgement in the next communication. This second acknowledgement is the 'PRV' data in the response packet.

The communications between the Game Engine and the Player Station intelligence is preferably a transaction-based protocol. Either device can start a transaction, which is why it is essential that there be an intelligent board at each player position. All packets of information may be sent in any acceptable format, with ASCII format preferred as a matter of designer choice. All command packets usually contain a sequence number that is incremented after each successful packet exchange. The Game Engine and the Player Station intelligence use sequence numbers that are independent of each other. The sequence number keeps the communications in synchronization. This synchronization method is described later.

The command packet is used to send various commands such as Inputs, Lamps, Doors, Errors, Chirp, Game Results, player input, coin acceptance, player identification, credit acceptance, wagers, etc . . . The command packet format may be, by ay of a non-limiting example:

<STX><Sequence number><Data Length><Data><CRC-16><ETX>

The data format with in the command packet may be:

<Address><Command><Field 1>|<Field 2>|<Field n>|

The response packet format may be:

<STX><Sequence number><Disposition><Previous ACK><ETX>

The sync request packet format may be:

<SYN>

The sync response packet format may be:

<STX><Mains Current Transmission Sequence><Mains Current Receive Sequence><ETX>

A major strength of the protocol is its resilience of the Game Protocol and its ability to free up resources within the game engine. Those resources can in turn be used to provide more intricate games, and multi-media affects.

Synchronization Method:

The satellite and host must become synchronized in order to provide for reliable communications using packet numbers. To facilitate this, a novel protocol synchronization method that is used. Upon applying power to the satellite, or after a communications failure, the satellite automatically enters into synchronization mode. In the synchronization mode the satellite sends out the ASCII SYN (0×16) character about every second. It is expecting a special response packet containing transmit and receive packet sequence numbers to be used from that point on. After receiving the special response packet, the sequence numbers are used as-is, and not incremented until a successful packet exchange is completed. After communications is synchronized, the sequence numbers are incremented after each packet is successfully sent or received.

As was noted before, the main game processor may contain information, data, programming and other necessary functions to enable the play of multiple games off the same machine. For example, the main game engine may have rules and commands that will enable play of high and low games of the present invention and other card games. The system may be controlled so that different games may be played at different times on command of the casino or players.

Figure 9:
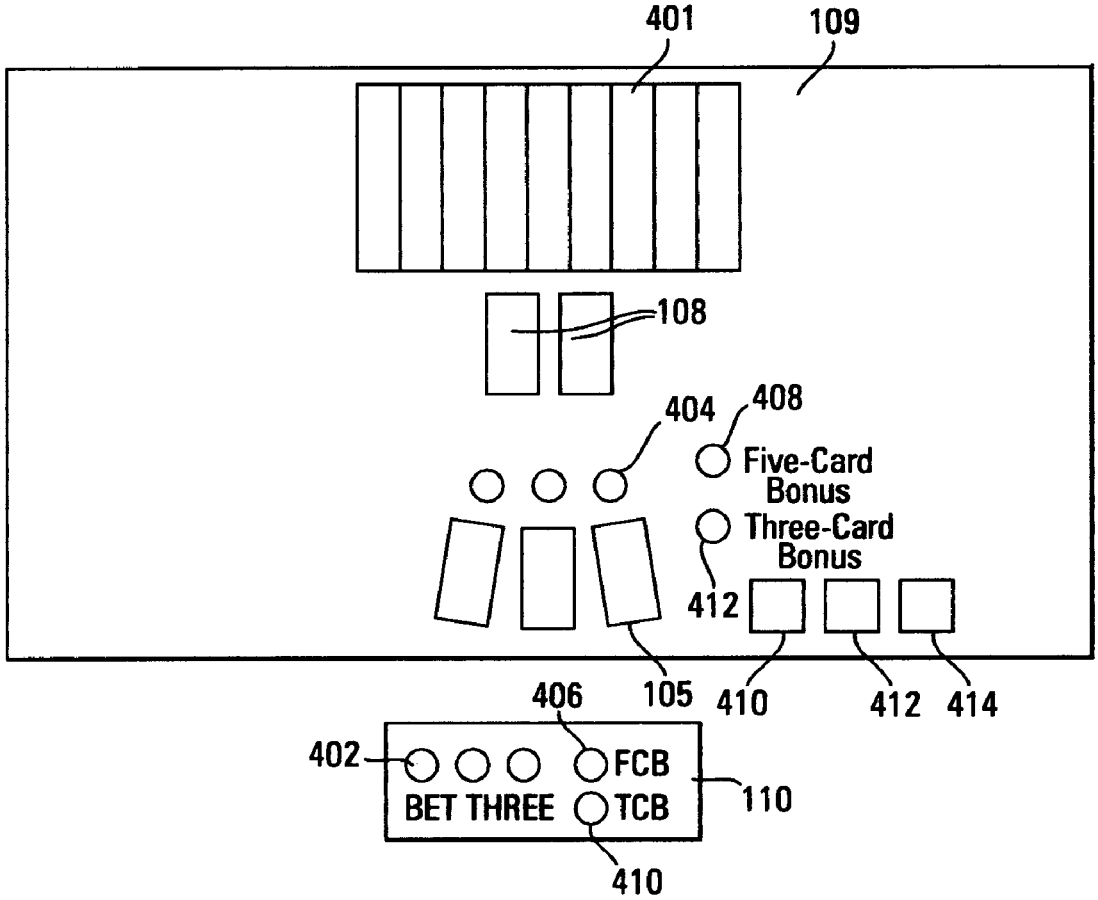
FIG. 9 is an overhead view of an example of a system configured to execute a poker-style game.

FIG. 9 is a front elevational view of an exemplary gaming table surface of the multiple player platform device of the present invention, configured to execute the game play steps of Let it Ride® with two optional bonuses, one for a five card hand and one for a three card hand. The top surface includes a continuous video monitor 109 and a player control panel 110. The player control panel 110 includes multiple betting buttons, which allow the player to play the game.

The device preferably operates on credits. When the player presses primary wager betting buttons 402 A, B and C, the bets are registered and displayed in area 404 on the display screen 109. Other button configurations, such as a single "Bet" and "Wager Number" buttons are contemplated. The wagers may be removed from the virtual chip tray 401 and are displayed in display areas 404 (for the primary three wagers), 408 (for the five card wager) and 412 (for the three card wager). Alternatively, chips appear only in the wagering display areas 404, 408 and 412, and no chip tray 401 is displayed. If the player chooses to place an optional wager on the five-card side bet, he depresses button 406, which causes wager 408 to display on the screen 109. Similarly, if the player wishes to wager on the three-card poker side bet, he depresses button 410 which in turn causes the wager to appear in betting area 412 on the display screen.

The control buttons work in similar fashion to a video poker machine. That is, the player plays on credits of a single denomination and can wager multiples of that denomination on each bet in the primary game by depressing the betting buttons multiple times. If the player wishes to withdraw a portion of his/her wager, he depresses the same button at the appropriate time and the display 109 shows an animation of the wager coming back to the player on the screen 109.

In one example of the invention, when the player makes the three-card poker side wager, the base game is fully played out before the side bet is resolved. In this form of the game, only the player knows his/her card values. In another form of the game, the three player cards 105 are dealt face up and the three-card side bet is resolved prior to the player making his first bet withdrawal decision. Players may refer to payout tables for the base game, the three card poker side bet and the five card poker side bet by viewing pay tables 410, 412, and 414 displayed on the table. These pay tables may be fixed, or the actual odds may become more liberal (or less liberal), depending on variables external to the game rules. For example, the pay tables may become more liberal to the player when the player advances to higher wager amounts. In this sense, the pay tables may be considered dynamic. What is meant by "dynamic" is that the payout odds from game to game may vary according to variables external to the game rules such as the identity and/or rating of the player, the time of day, the play session duration, the particular dealer at the table, information the casino collected from the player during hotel registration, historical data on the player, comp credits issued to the player and a host of other possible variables.

The display 109 as shown in FIG. 9 can be readily seen by all players, and it is to be understood that the player control board 110, the wagering areas 404, 408, 410 and the card area 105 are located at every player position. The pay table displays 410, 412 and 414 are available to all players to view, but may or may not be at each individual player location. The dynamic display could be present on the main screen 109, on a separate screen or upright display, be located at each player location or between player locations. As long as the information is viewable to the player, the location of the dynamic display is unimportant.

Although specific components, materials, sequences and rules have been provided in these descriptions to enable practice, it is clear to one skilled in the art that alternatives, variations, equivalents and the like may be used within the enabled scope of practice.

What is claimed:

1. A multi-player platform that provides multiple player positions for live players to engage in an interactive stud poker game with a virtual dealer and virtual cards comprising at least two player positions that enable live players to place wagers on an underlying poker-type game, a display system for showing a virtual dealer, a display system for showing at least the virtual cards used in play of the underlying poker-type game, and a processor that contains the rules of the underlying poker-type game, the processor enabling play for each player on the underlying poker-type game according to the following rules:

playing a wagering card game for a number of players using standard playing cards having a standard rank, said game involving standard poker hand rankings and comprising the steps of:

each player placing a wager to participate in the game;

dealing at least one card to each player and at least one common card, all of said cards being dealt face down;

giving each player the chance to examine the cards received by that player and to withdraw at least part of said wager based on the rank of said player's cards;

showing said at least one common card, thereby providing a hand for each player, each player's hand comprising said shown at least one common card and the at least one card each player was dealt; and resolving each player's remaining wager, which was not withdrawn based on the rank of that player's hand.

2. The platform according to claim 1, said wager comprising at least two parts.

3. The platform according to claim 2, wherein the quantity of said at least two parts is at least one more than the quantity of said at least one common card.

4. The platform according to claim 1, wherein said wager is divided into parts and wherein the number of said parts of said wager that may be withdrawn is equal to the number of said at least one common card.

5. The platform according to claim 4, wherein said parts of said wager are equal.

6. The platform according to claim 1 wherein the display system for showing at least the virtual cards also displays virtual wagering chips.

7. The platform of claim 1, wherein the rules permit the player to optionally place one or more side bets.

8. An automated wagering gaming event system comprising:

at least two distinct video displays, a first display for showing a dealer in a card game and at least a second display showing at least playing cards to individual players;

at least one processor for enabling play of the wagering gaming event;

multiple player positions to enable multiple players to play the game;

wherein at least one processor can feed at least two different multiple video images and merge the at least two multiple video images to form a composite image of a dealer against a background, wherein the background comprises at least one dynamic image and the system displays images enabling play of a game according to the following rules:

playing a wagering card game for a number of players using standard playing cards having a standard rank, said game involving standard poker hand rankings and comprising the steps of:

each player placing a wager to participate in the game;

dealing at least one card to each player and at least one common card;

giving each player the chance to examine the cards received by tat player and to withdraw at least part of said wager based on the rank of said player's cards;

showing said at least one common card, thereby providing a hand for each player, each player's hand comprising said shown at least one common card and the at least one card each player was dealt; and resolving each player's remaining wager, which was not withdrawn based on the rank of that player's hand.

9. The system of claim 8, said wager comprising at least two parts.

10. The system according to claim 9, wherein the quantity of said at least two parts is at least one more than the quantity of said at least one common card.

11. The system according to claim 9, wherein said wager is divided into parts and wherein the number of said parts of said wager that may be withdrawn is equal to the number of said at least one common card.

12. The system according to claim 11, wherein said parts of said wager are equal.

13. The system of claim 8, wherein the rules permit the player to optionally place one or more side bets.

* * * * *